US009487732B2

(12) United States Patent
Komiyama et al.

(10) Patent No.: US 9,487,732 B2
(45) Date of Patent: Nov. 8, 2016

(54) LUBRICATING COATING AGENT FOR PLASTIC WORKING AND METHOD FOR PRODUCING THE SAME

(71) Applicant: Henkel AG & Co. KGaA, Duesseldorf (DE)

(72) Inventors: Shinobu Komiyama, Tokyo (JP); Atsushi Serita, Tokyo (JP); Hitoshi Ishii, Tokyo (JP); Kazuhiko Mori, Tokyo (JP)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/040,053

(22) Filed: Sep. 27, 2013

(65) Prior Publication Data

US 2014/0162917 A1 Jun. 12, 2014

Related U.S. Application Data

(63) Continuation of application No. PCT/JP2012/058004, filed on Mar. 27, 2012.

(30) Foreign Application Priority Data

Mar. 28, 2011 (JP) ..... 2011-069106

(51) Int. Cl.
*C10M 125/22* (2006.01)
*C01F 11/46* (2006.01)
(Continued)

(52) U.S. Cl.
CPC ..... *C10M 173/02* (2013.01); *C10M 103/06* (2013.01); *C10M 171/06* (2013.01);
(Continued)

(58) Field of Classification Search
CPC . C01F 11/46; C10M 125/22; C10M 2201/00
USPC ..... 508/154–180; 72/42; 423/555
See application file for complete search history.

(56) References Cited

U.S. PATENT DOCUMENTS 4,168,241 A * 9/1979 Kozima et al. ..... 508/129
4,308,182 A * 12/1981 Eckard et al. ..... 524/270
(Continued)

FOREIGN PATENT DOCUMENTS

JP 5355448 A 5/1978
JP 5230493 A 9/1993
(Continued)

OTHER PUBLICATIONS

International Search Report for PCT/JP2012/058004, mailed May 22, 2012, 2 pages.
(Continued)

*Primary Examiner* — Ellen McAvoy
(74) *Attorney, Agent, or Firm* — Mary K. Cameron

(57) ABSTRACT

To provide a lubricating coating agent for plastic working, containing a non-black solid lubricating material, and a metal material coated with the agent, which enable highly difficult forging that has been conventionally difficult to practically apply to anything except lubricating coating films containing a black solid lubricant typified by molybdenum disulfide. The problems can be achieved by means of a lubricating coating agent for plastic working, which is characterized by containing, at 5 mass % or more in terms of solid content ratio in a coating film, a calcium sulfate hydrate with a particular scale-like crystal shape among calcium sulfate hydrates deposited by reacting a sulfuric acid or a sulfate with a calcium compound in water, and a metal material coated with the agent.

15 Claims, 8 Drawing Sheets

BONDERIZING TREATMENT PROCESS (REQUIRED TIME: 24 MINUTES)

ONE-LIQUID LUBRICATING COATING TREATMENT PROCESS (REQUIRED TIME: 3 MINUTES)

(51) Int. Cl.
*C10M 173/02* (2006.01)
*C10M 103/06* (2006.01)
*C10M 171/06* (2006.01)

(52) U.S. Cl.
CPC .. *C10M2201/041* (2013.01); *C10M 2201/061* (2013.01); *C10M 2201/066* (2013.01); *C10M 2201/084* (2013.01); *C10M 2201/085* (2013.01); *C10M 2201/087* (2013.01); *C10M 2201/103* (2013.01); *C10M 2201/14* (2013.01); *C10M 2205/14* (2013.01); *C10M 2205/16* (2013.01); *C10M 2207/125* (2013.01); *C10M 2207/126* (2013.01); *C10M 2215/222* (2013.01); *C10N 2210/02* (2013.01); *C10N 2230/06* (2013.01); *C10N 2230/12* (2013.01); *C10N 2230/26* (2013.01); *C10N 2240/40* (2013.01); *C10N 2250/12* (2013.01)

(56) References Cited

U.S. PATENT DOCUMENTS

| | | | | |
|---|---|---|---|---|
| 4,931,161 | A * | 6/1990 | Sundar | 208/13 |
| 5,033,950 | A * | 7/1991 | Will | 425/84 |
| 5,173,204 | A * | 12/1992 | Chiddick et al. | 508/167 |
| 5,308,516 | A * | 5/1994 | Chiddick | 508/161 |
| 6,194,357 | B1 | 2/2001 | Murata et al. | |
| 6,455,476 | B1 | 9/2002 | Imai et al. | |
| 6,998,128 | B2 * | 2/2006 | Haggard et al. | 424/400 |
| 8,344,084 | B2 * | 1/2013 | Bichler et al. | 526/287 |
| 8,450,254 | B2 * | 5/2013 | Eadie et al. | 508/116 |
| 2003/0130137 | A1 | 7/2003 | Imai et al. | |
| 2005/0019496 | A1 * | 1/2005 | Yoshida et al. | 427/299 |
| 2008/0206444 | A1 * | 8/2008 | Matsuo et al. | 427/11 |
| 2010/0202990 | A1 | 8/2010 | Murata et al. | |

FOREIGN PATENT DOCUMENTS

| | | | |
|---|---|---|---|
| JP | 1036876 | A | 2/1998 |
| JP | 2000063880 | A | 2/2000 |
| JP | 3314201 | B2 | 8/2002 |
| JP | 3517522 | B2 | 4/2004 |
| JP | 2006335578 | A | 12/2006 |
| JP | 2009185311 | A | 8/2009 |
| JP | 2010094731 | A | 4/2010 |
| WO | 0212419 | A1 | 2/2002 |
| WO | 2008062538 | A1 | 5/2008 |
| WO | 2009037901 | A1 | 3/2009 |

OTHER PUBLICATIONS

Male, A.T. and Cockcroft, M.G.: Journal of the Institute of Metals, 93 (1964), pp. 38-46.
Akinori Takahashi, et al, 62nd Plastic Working Federation Lecture Meeting Preprint (2011), pp. 89-90.
Supplementary European Search Report for EP application 12763474, mailed Oct. 22, 2014.

* cited by examiner $CaSO_4 \cdot 2H_2O$

CRYSTAL APPEARANCE DIAGRAM OF SYNTHESIZED CRYSTAL (1) UPPER MOLD, (2) LOWER MOLD (LAND LENGTH: 1 mm), (3) SIDE DIE, (4) TEST PIECE (WORK TO BE PROCESSED)

LUBRICATING COATING AGENT FOR PLASTIC WORKING AND METHOD FOR PRODUCING THE SAME

TECHNICAL FIELD

The present invention relates to a lubricating coating agent for plastic working, which is formed on the surface of a material to be worked or a mold for the purpose of lubrication and seizure prevention in plastic working for metal, and a metal material coated with the agent.

BACKGROUND ART

Plastic working such as wire drawing, pipe drawing, plate press, heading, and forging requires a lubricating film at the frictional interface between a mold and a material to be worked, and if this lubricating film is insufficient, defects will be caused such as difficulty in working into desired shapes and seizure formation. In particular, cold forging produces an extremely high contact pressure between a mold and a material to be worked, and the mold and the material to be worked relatively slide with the enlarged surface of the material to be worked even to dozens of times. While the lubricating film therebetween requires a high friction reducing ability and a seizure suppressing ability, handling with the use of a lubricating oil is difficult in such an environment, and lubrication with the use of a solid film is thus typically used.

Chemical conversion coating film for crystallization of zinc phosphate crystals on steel surfaces in combination with soap based lubricants, which are commonly known as bonderizing and bonderlube coating films have been long used extensively for lubricating films in the field of cold forging. The zinc phosphate crystals have cleaved facets with a weak bonding force between crystal lattices, and produce cleavages against the shear force at forging frictional interfaces to reduce frictions, and also repair and coat materials to be worked. For this reason, the zinc phosphate crystal films excel in seizure suppressing ability. For the soap based lubricant for coating the zinc phosphate crystal films as an upper layer, alkali soap is typically used which serves to reduce frictions. At the interface between the zinc phosphate crystals and the alkali soap layers, a zinc soap layer that is excellent in lubricating property is also produced by double decomposition reaction to further enhance the lubricating property. The combination of the excellent ability of the phosphate film to resist seizure with the soap lubricating layer associated with a reaction stably supplies lubrication in cold forging. It is not an exaggeration to say that most of the lubricating films used in the current cold forging industry are bonderizing and bonderlube coating films.

On the other hand, with the recently heightened consciousness of environmental conservation, film formation methods for bonderizing and bonderlube coating films have been acknowledged as a problem. In a bonderizing treatment for dissolving and then crystallizing iron and steel materials, there is a need to eliminate iron constantly dissolved into the treatment liquid to the outside of the system as by-products such as iron phosphate crystals. Large amounts of heavy-metal containing waste water, soapy effluent, and the like are discharged, which result in large amounts of industrial waste. In addition, in the treatment process in which the treatment bath temperature reaches even 80° C. or higher, the heat source, the supply of volatilized water, etc. are also fairly costly. In particular, bonderizing treatment equipment directed to steel-wire coiled materials, pipes, and the like has a considerably large scale, and also has high environmental burdens, and there has been thus an urgent need to take countermeasures.

Recently, in order to solve such problems, new environmentally-sound lubricating coating films are being developed which aim at alternatives to bonderizing as exemplified below. Many of these lubricating coating films can be formed by a simple process of just applying a coating treatment liquid to the surfaces of objects and then drying the liquid, and are thus called one-pack type lubricating coating films, and attracting attention.

Patent Literature 1 (Japanese Patent No. 3517522) consists in an aqueous lubricant for cold plastic working containing a specific water-soluble inorganic salt, a solid lubricant, an oil component, and a surfactant in specific proportions. The films formed on the surfaces of iron and steel materials contain each lubricating component based on the water-soluble inorganic salt which has strong adhesion, and introduce the lubricating components to the worked interfaces between the surfaces and a mold. An example with a backward extrusion test as a forging test with a high degree of difficulty in working demonstrates a cold forging performance which is equivalent to comparative bonderizing and bonderlube treatment, and is generally understood as a candidate for alternatives to the bonderizing and bonderlube treatment.

Patent Literature 2 (Japanese Patent No. 3314201) consists in a water-borne cold-forging lubricant of steel or steel alloy characterized in that it is obtained by dispersing an alkylphosphonic acid derivative having a specific structure in water along with a surfactant. In the evaluation of lubricating coating films obtained by forming the lubricant into steel materials, with various types of sliding tests and forging tests, or forging with an actual machine, the films are considered to show favorable results even as compared with bonderizing and bonderlube coating films.

As described above, the lubricating performance of one-pack type lubricating coating films as new lubricating coating films in cold forging is approaching the practical level. FIG. 1 shows line configuration examples of bonderizing treatment and one-pack type lubricating coating treatment. The process of the one-pack type lubricating coating treatment produces no waste water, industrial waste or the like, and requires a small space and a low energy cost for the coating treatment. It is also capable of in-line processes in which the coating treatment unit is directly connected to a forging machine, and has the potential to succeed in significantly improving the layouts of future manufacturing sites.

In recent automobile industry, efforts have been advanced which are aimed at further increasing the efficiency of part manufacturing, and studies have been carried out in which cold forging is intended for even complex-shape parts which have been thus far formed by cutting work. Closed forging with a high degree of difficulty is frequently used for filling even details of a complex mold shape with a material to be worked, and the surface of the material to be processed, which is drawn by working with a large amount of change, is forced to relatively slide with respect to the mold surface under extremely high contact pressure. Lubricating coating films have important roles such as preventing seizure by preventing direct contact between the mold and the material to be worked even while being located at the frictional interface, and reducing the friction for promoting plastic flows of the material to be worked. The lubricating coating films are heavily involved in all of workability of complex shapes, dimensional accuracy, mold life, etc., and the bonderizing and bonderlube coating films and one-pack type lubricating coating films described previously are even being considered inadequate, under the condition that the performance required for the lubricating coating films is becoming more and more stringent.

Disclosures of high-performance lubricating coating films aimed at dealing with severer working, such as in the closed forging field for complex shape parts, include Patent Literature 3 (International Publication No. WO2002/012419). The disclosed aqueous lubricant for plastic working of metal materials contains (A) an water-soluble inorganic salt, (B) one or more lubricating agents selected from molybdenum disulfide and graphite, and (C) a wax, is characterized in that these components are dissolved or dispersed in water, and the solid content concentration ratios (ratios by weight) (B)/(A) and (C)/(A) are respectively 1.0 to 5.0 and 0.1 to 1.0, and raises the performance by containing one or more selected from molybdenum disulfide and graphite contained at the given ratio, as compared with one-pack type lubricating coating films disclosed before that in Patent Literature 4 (Japanese Patent Application Laid-Open No. 2000-63880), etc. These beneficial effects are considered due to friction relaxation by flatting of the so-called solid lubricant, such as molybdenum disulfide and graphite, into thin films over frictional interfaces, and seizure suppression by the surface coating, and believed to suggest importance of the roles of solid lubricants in lubricating coating films intended for forging with a high degree of difficulty.

On the other hand, from recent working environment situations requesting cleaner work environments, the use of black substances has been disliked in many cases, there have been also moves to demand the elimination of industrial raw materials that face risks such as instability of raw material procurement and pricing due to the international situation, and thus, in the future, it will not be possible to rely on lubricating coating films containing black solid lubricating materials such as molybdenum disulfide, tungsten disulfide or graphite. Against such a background, there has been demand for the emergence of a novel solid lubricating material which is less likely to face risks due to raw material procurement or cost fluctuations, and in a non-black color that is less likely to contaminate work environments, and which is able to demonstrate excellent forging performance.

As non-black solid lubricants, melamine cyanurate, boron nitride, carbon fluoride, etc. are famous, and many of lubricants containing these materials are disclosed. Patent Literature 5 (Japanese Patent Application Laid-Open No. HEI 10-36876) as an example thereof discloses an example of a lubricating coating film containing melamine cyanurate, which is supposed to keep a lubricating property equivalent to those of phosphates. However, these solid lubricants are generally high in price, and thus difficult to use, and moreover, in order to stably blend these solid lubricants into lubricating coating films, there is a need to disperse the lubricants over a long period of time while grinding the lubricants into microparticles with the use of an expensive grinding disperser as typified by, for example, beads mills. Therefore, the investment in the grinding disperser and the manufacturing cost from the manufacturing time have been substantially increased, and the solid lubricants are thus not realistic as a technique introduced into "manufacturing sites" currently calling for cost reductions.

CITATION LIST

Patent Literature

Patent Literature 1: Japanese Patent No. 3517522

Patent Literature 2: Japanese Patent No. 3314201

Patent Literature 3: International Publication No. WO2002/012419

Patent Literature 4: Japanese Patent Application Laid-Open No. 2000-63880

Patent Literature 5: Japanese Patent Application Laid-Open No. HEI 10-36876

SUMMARY OF INVENTION

Technical Problem

An object of the present invention is to provide a lubricating coating agent for plastic working, containing a non-black solid lubricating material, and a metal material coated with the agent, which enable highly difficult forging that has been conventionally difficult to practically apply to anything except lubricating coating films containing a black solid lubricant typified by molybdenum disulfide.

Solution to Problem

The object can be achieved by means of a lubricating coating agent containing a calcium sulfate hydrate. The content of the calcium sulfate hydrate in a coating film needs to be 5 mass % or more in terms of solid content ratio. The calcium sulfate hydrate according to the present invention has a scale-like shape of 1.5 μm or less in single crystal thickness, which is preferably synthesized so that the intensity ratio of (020) plane/(021) plane is 10 or more by an X-ray diffraction method.

Effects of Invention

The lubricating coating agent for plastic working according to the present invention containing, as a non-black solid lubricating material, a calcium sulfate hydrate that has a specific crystal shape allows highly difficult forging without relying on molybdenum disulfide or the like as an expensive and black solid lubricant. The lubricating coating agent according to the present invention has a solid lubricant easily dispersed in a treatment liquid for the lubricating coating agent without relying on equipment such as a grinding disperser in the case of blending the calcium sulfate hydrate as a solid lubricating component, and provides no pressure on the manufacturing cost because it is easy to make the lubricating coating agent as an industrial material, and the present invention is thus extremely useful in industrial applications such as its great economic effects on forging industry.

DESCRIPTION OF EMBODIMENTS

Figure 1:
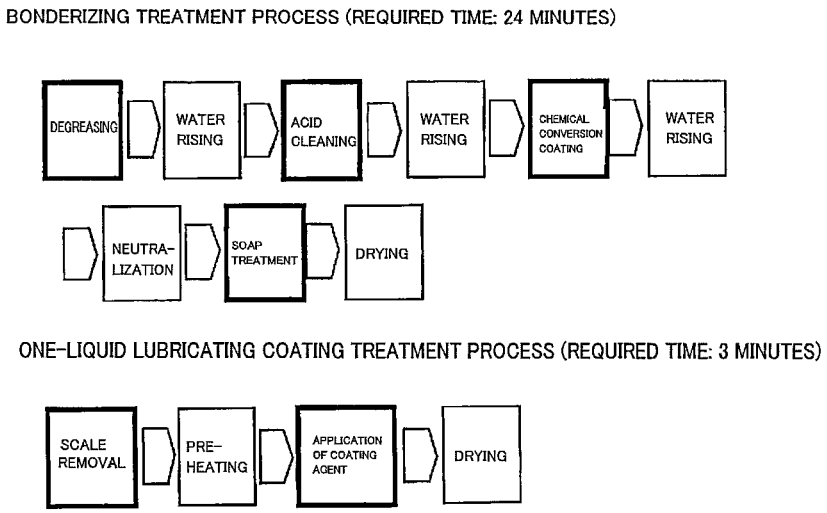
FIG. 1 is a diagram illustrating line configuration examples of bonderizing treatment and one-pack type lubricating coating treatment.

The present invention will be described below in detail. It is to be noted that the embodiments described below are by way of example, and the present invention is not to be considered limited to the present embodiments.

Materials to be processed in the present invention, which are to be subjected to plastic working, include metal materials to be subjected to plastic working, mainly such as iron, iron and steel, stainless steel, aluminum, magnesium, copper, and titanium, and these materials are used in the shape of a sheet, a stick, a tube, a slag, etc., depending on the intended uses.

The calcium sulfate hydrate as the non-black solid lubricating material contained in the lubricating coating film for plastic working according to the present invention needs to be contained in the lubricating coating film for plastic working at 5 mass % or more in terms of solid content ratio. In order to bring out an adequate seizure suppressing ability as the lubricating coating film for plastic working, the calcium sulfate hydrate is preferably contained at 10 mass % or more, more preferably at 30 mass % or more. It is to be noted that the upper limit is not particularly limited, but for example, 100 mass %. Examples of the calcium sulfate hydrate include calcium sulfate dihydrates and calcium sulfate ½ hydrates.

It is to be noted that the non-black solid lubricating material according to the present invention refers to having an L* value of 50 or more in the L*a*b* color specification system (JIS-Z-8729), which is measured with a colorimeter for a petri dish (inside diameter: 85.5 mmϕ, height: 20 mm) filled with a solid lubricating material powder passing through a sieve opening of 300 μm in mesh size.

The calcium sulfate hydrate for use in the present invention is synthesized through a double decomposition reaction by bringing, in water, a sulfuric acid or a sulfate {for example, an alkali metal salt (for example, a sodium salt or a potassium salt) or a magnesium salt of a sulfuric acid into contact with a calcium compound such as calcium hydroxide and a calcium salt of an inorganic acid or an organic acid (for example, calcium carbonate, various types of calcium phosphate, calcium chloride, calcium oxalate, calcium citrate). For example, a suspension that has hydrate crystals of calcium sulfate deposited and dispersed in water can be produced by dispersing a calcium carbonate powder in water with the use of a propeller agitator, followed by adding a sulfuric acid including sulfate radical ($SO_4$) while agitation. It is to be noted that a method may be adopted in which a dispersion liquid of calcium carbonate is added into a sulfuric acid. While the reaction herein is ideally an equimolar reaction with the calcium in the calcium compound (for example, calcium carbonate), it is preferable to add slightly more sulfate radical in light of reaction efficiency (for this reason, it is preferable to carry out neutralization by adding an alkali as will be described later). In this case, while the shape of the calcium sulfate hydrate crystal produced in the suspension varies significantly depending on various synthetic environments such as concentration and temperature, scale-like microcrystals are made more likely to be obtained, for example, when the synthesis is carried out in such a way that the concentration of the synthesized and deposited calcium sulfate hydrate crystal is 10 mass % or less, and that the reaction temperature is controlled to 30° C. or lower. Further, it is also preferable to increase the efficiency of the propeller agitation or the like in the synthesis. The suspension of the calcium sulfate hydrate crystal synthesized and deposited as previously described is typically neutralized for use to around neutral pH or higher with the addition of an alkali such as sodium hydroxide. It is not preferable to attempt to create a dried film of calcium sulfate crystals with a lot of unreacted sulfuric acid left, because non-hydrate that is poor in lubricating property is likely to be produced in the drying process.

Figure 2:
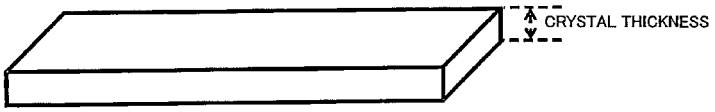
FIG. 2 shows a shape image of a calcium sulfate hydrate crystal produced by a dispersion synthesis method according to the present invention and a site for observing the crystal thickness.
Figure 3:
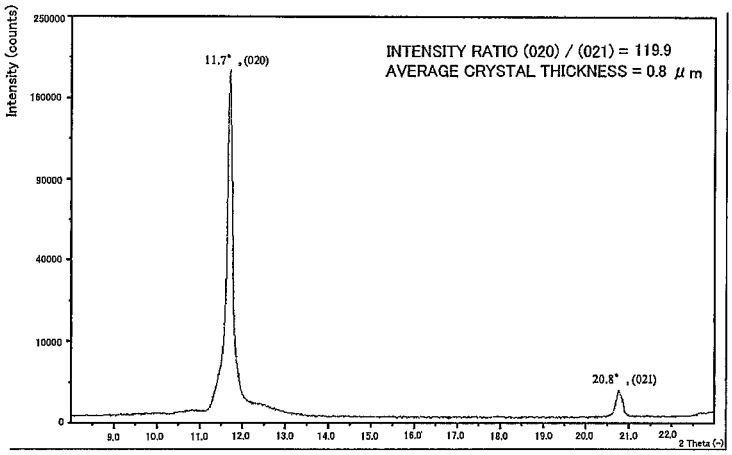
FIG. 3 is a chart example obtained when a calcium sulfate hydrate crystal which can be used in the present invention is analyzed by an X-ray diffraction method, where the intensity ratio of (020) plane/(021) plane is 10 or more.
Figure 4:
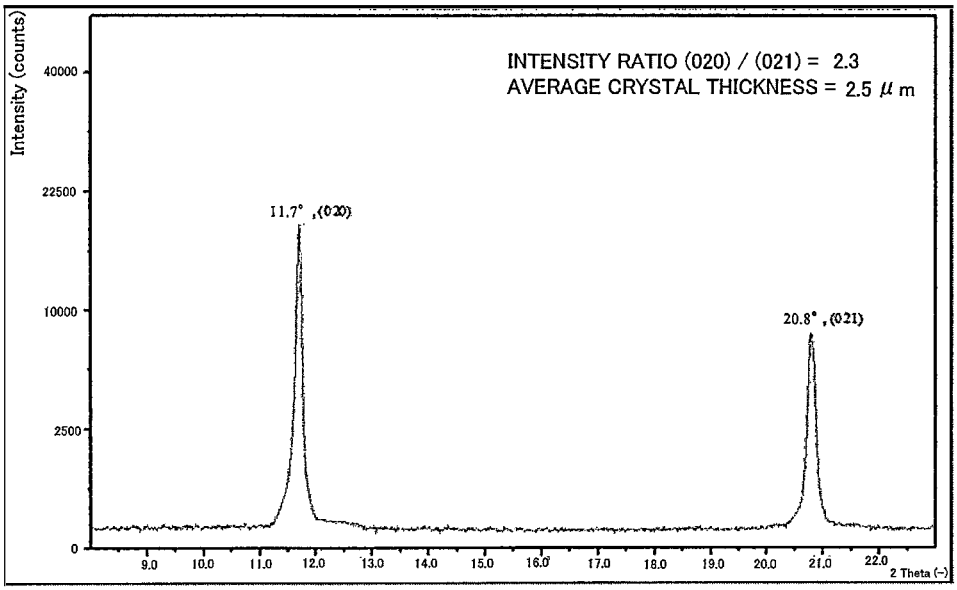
FIG. 4 is a chart example obtained when a calcium sulfate hydrate crystal which has a shape outside the scope of the present invention is analyzed by an X-ray diffraction method, where the intensity ratio of (020) plane/(021) plane is less than 10.

The average shape for a single crystal, which is measured from an image obtained by observing, under a scanning electron microscope, the calcium sulfate hydrate crystal synthesized by the method described above, needs to be a scale-like shape of 1.5 μm or less in average thickness for the crystal shown in the schematic diagram of crystal appearance illustrated in FIG. 2. The average thickness herein is an average value for measurement results among 100 crystals randomly selected on the SEM. It is to be noted that the lower limit of the average thickness for the crystal is not particularly limited, but for example, 0.1 μm. In addition, the intensity ratio of (020) plane/(021) plane is preferably 10 or more, more preferably 30 or more, and further preferably 50 or more, which is obtained from an analysis result obtained by an X-ray diffraction method using a Cu tube as illustrated in FIG. 3, which is directed to a smooth surface of a crystal aggregation formed on a flat surface (for example, on a surface of a plate made of glass or tetrafluoroethylene) in such a way that an aqueous dispersion of the synthesized calcium sulfate hydrate crystal added into pure water is dried for solidification at a temperature of 80° C. or lower on the flat surface. The intensity ratio of (020) plane/(021) plane in the present preferred embodiment is indicative of how likely it is that the calcium sulfate hydrate crystal has a stacked structure selectively oriented at the (020) plane, and the intensity ratio of (020) plane/(021) plane is less than 10 when the shape of the synthesized calcium sulfate hydrate crystal is not an adequate scale-like shape (for example, a columnar or massive crystal grown in excess of 1.5 μm in crystal thickness) as illustrated in FIG. 4. When the intensity ratio of (020) plane/(021) plane is less than 10 in the calcium sulfate hydrate crystal blended in the lubricating coating agent, the sparse aggregation density of the calcium sulfate hydrate crystal in the lubricating coating film makes the film likely to drop off without being able to withstand the shear force in the case of being introduced into the contact interface between a mold and the surface of a material to be worked in plastic working, thus making it difficult to develop a function as the lubricating coating film required in the present preferred embodiment. It is to be noted that while the preferable upper limit is considered less than 200 in a realistic sense in the present preferred embodiment because it is generally difficult to synthesize a calcium sulfate hydrate crystal with the intensity ratio of (020) plane/(021) plane of 200 or more, the present preferred embodiment is not limited to this upper limit because ideally, the stacked structure in the selective (020) plane orientation is densified in the lubricating coating film to make a significant contribution to an improvement in the performance of the lubricating coating film as the intensity ratio of (020) plane/(021) plane is increased.

It is to be noted that the use of commercially available products of calcium sulfate, such as natural gypsum, and chemical gypsum as a byproduct from inorganic or organic chemical industry, is not suited for the purpose of the present preferred embodiment, because there is a need for dispersion in fine particles with the use of a grinding disperser such as a beads mill or a homogenizer in producing an aqueous coating agent as in the case of the non-black solid lubricant mentioned previously, thereby significantly increasing the production cost.

The lubricating coating agent for plastic working according to the present invention can contain a binder component blended in combination with the calcium sulfate hydrate. The binder component blended firmly solidifies the calcium sulfate hydrate on the surface of the material to be worked, thereby promoting the introduction to the frictional interface during plastic working, and thus enhancing the lubricating performance of the lubricating coating agent for plastic working according to the present invention. While the binder component which can be used is not to be considered limited, examples thereof include aqueous inorganic salts, aqueous organic acid salts, and aqueous resins. These may be used by themselves, or two or more thereof may be used in combination.

The aqueous inorganic salts include sulfates, salts of boric acids, salts of phosphoric acids, salts of tungstic acids, and salts of silicic acids. Cations of these salts of acids include alkali metal ions (such as sodium ions, potassium ions, and lithium ions), ammonium ions, and cations (amine salts as salts) formed from amines (such as ethylamine) and alkanolamines (such as monoethanolamine and diethanolamine), and alkali metal ions and ammonium ions are more preferred. The aqueous inorganic salts specifically include sodium sulfate, potassium sulfate, lithium borate (such as lithium tetraborate), sodium borate (such as sodium tetraborate), potassium borate (such as potassium tetraborate), a diethanolamine salt of a boric acid, sodium silicate, potassium silicate, lithium silicate, sodium metasilicate, sodium phosphate, potassium phosphate, sodium tripolyphosphate, lithium tungstate, sodium tungstate, and potassium tungstate. The salts of silicic acids can be used which are represented by the general formula $M_2O\text{-}nSiO_2$ (in the formula, n represents 1 to 9, and M represents Na, K, Li, or $NH_4$). These may be used by themselves, or two or more thereof may be used in combination.

The salts of dibasic or tribasic carboxylic acids having 3 to 6 carbon atoms with or without a hydroxyl group are preferably used as the aqueous organic acid salts, and it is more preferable to use at least one selected from malates, succinates, citrate, and tartrate. Cations of these salts of acids include alkali metal ions (such as sodium ions, potassium ions, and lithium ions), ammonium ions, and cations (amine salts as salts) formed from amines (such as ethylamine) and alkanolamines (such as monoethanolamine and diethanolamine), and alkali metal ions and ammonium ions are more preferred. The aqueous organic acid salts specifically include sodium malate, potassium malate, sodium succinate, potassium succinate, sodium citrate, potassium citrate, sodium tartrate, and potassium tartrate. These may be used by themselves, or two or more thereof may be used in combination.

As the aqueous resins, it is preferable to use at least one selected from acrylic resins, phenolic resins, urethane resins, epoxy resins, polyester resins, and isobutylene resins. The aqueous resins used herein are not particularly limited as long as coating films are able to be formed from the aqueous resins, and typically supplied in a water-soluble or aqueous dispersion state. These aqueous resins may be used by themselves, or two or more thereof may be used in combination.

The acrylic resins include resins obtained by the polymerization of at least one of acrylic monomers. The acrylic monomers include: alkyl (C=1 to 8) (meth)acrylates such as methylacrylate, methylmethacrylate, ethylacrylate, ethylmethacrylate, isopropyl methacrylate, n-butyl acrylate, n-butyl methacrylate, 2-ethylhexyl methacrylate, and octyl acrylate; lower alkoxy-lower alkyl(meth)acrylates such as methoxy methyl acrylate, methoxy ethyl acrylate, ethoxy methyl acrylate, ethoxy ethyl acrylate, methoxy methyl methacrylate, methoxy ethyl methacrylate, ethoxy methyl methacrylate, ethoxy ethyl methacrylate, and methoxy butyl acrylate; hydroxy lower alkyl(meth)acrylates such as 2-hydroxyethyl(meth)acrylate and 3-hydroxypropyl(meth)acrylate; acrylamide and methcrylamide; (meth)acrylamides having an N-unsubstituted or substituted (in particular, lower alkoxy substituted) methylol group, such as N-methylol acrylamide, N-methylol methacrylamide, N-butoxymethyl acrylamide, and N-butoxymethyl methacrylamide; phosphonyloxy lower alkyl(meth)acrylates such as phosphonyloxy methyl acrylate, phosphonyloxy ethyl acrylate, phosphonyloxy propyl acrylate, phosphonyloxy methyl methacrylate, phosphonyloxy ethyl methacrylate, and phosphonyloxy propyl methacrylate; acrylonitrile; and acrylic acids and methacrylic acids. In the present invention, the acrylic resins encompass copolymers of at least one of the acrylic monomers as mentioned above and at least one of other ethylenic monomers such as styrene, methylstyrene, vinyl acetate, vinyl chloride, vinyl toluene, and ethylene, which contain an acrylic monomer unit at 30 mol % or more.

The phenolic resins include resins obtained by a reaction between at least one of phenols such as phenol, cresol, and xylenol, and formaldehyde, which may be any of novolac-type resins and resol-type resins. In the case of using a novolac-type resin, there is a need for coexistence with hexamethylenetetraamine or the like as a curing agent. The phenolic resin film is cured in a drying step as described later.

The urethane resins refer to synthetic resins having a urethane linkage (NHCOO), and resins obtained by a polyaddition reaction between a polyisocyanate compound having two or more isocyanate groups and a polyol having two or more active hydrogen groups can be typically used as the urethane resins. Examples of the polyol include polyester polyols and polyether polyols. The polyester polyols include polyester compounds having a terminal hydroxyl group, which are obtained, for example, by a reaction between a low molecular weight polyol such as ethylene glycol, diethylene glycol, triethylene glycol, 1,2-propylene glycol, 1,3-propylene glycol, neopentyl glycol, 1,2-butylene glycol, 1,3-butylene glycol, 1,4-butylene glycol, 3-methylpentanediol, hexamethylene glycol, hydrogenated bisphenol A, trimethylolpropane, or glycerin and a polybasic acid such as succinic acid, glutaric acid, adipic acid, sebacic acid, phthalic acid, isophthalic acid, terephthalic acid, trimellitic acid, tetrahydrophthalic acid, endomethylenetetrahydrophthalic acid, or hexahydrophthalic acid.

In addition, the polyether polyols include, for example, low molecular weight polyols such as ethylene glycol, diethylene glycol, triethylene glycol, 1,2-propylene glycol, 1,3-propylene glycol, neopentyl glycol, 1,2-butylene glycol, 1,3-butylene glycol, 1,4-butylene glycol, 3-methylpentanediol, hexamethylene glycol, bisphenol A, hydrogenated bisphenol A, trimethylolpropane, or glycerin, or ethylene oxide and/or propylene oxide adducts thereof, polyether polyols such as polyethylene glycol, polypropylene glycol, and polyethylene/propylene glycol, polycaprolactone polyols, polyolefin polyols, and polybutadiene polyols.

Furthermore, the polyisocyanates include aliphatic, alicyclic, and aromatic polyisocyanates, and specifically include tetramethylene diisocyanate, hexamethylene diisocyanate, lysine diisocyanate ester, hydrogenated xylylene diisocyanate, 1,4-cyclohexylene diisocyanate, 4,4'-dicyclohexyl methane diisocyanate, 2,4'-dicyclohexyl methane diisocyanate, isophorone diisocyanate, 3,3'-dimethoxy-4,4'-biphenylene diisocyanate, 1,5-naphthalene diisocyanate, 1,5-tetrahydronaphthalene diisocyanate, 2,4-tolylenediisocyanate, 2,6-tolylenediisocyanate, 4,4-diphenylmethane diisocyanate, 2,4'-diphenylmethane diisocyanate, phenylene diisocyanate, xylylene diisocyanate, and tetramethylxylylene diisocyanate.

The epoxy resins first include bisphenol resins, in particular, bisphenol type epoxy resins, which are obtained by reactions between bisphenol A (2,2-bis(4'-hydroxyphenyl) propane) and epichlorohydrin, in particular, bisphenol A type epoxy resin represented by the following formula. Other examples thereof can include novolac-type epoxy resins obtained by glycidyl etherification of phenolic hydroxyl groups of phenolic novolac resins, glycidyl esters of aromatic carboxylic acids, and peracid epoxy-type resins obtained by epoxidation of double bonds of ethylenically unsaturated compounds with a peracid. Furthermore, the examples can include the resin skeletons of epoxy resins with an ethylene oxide or a propylene oxide added thereto as mentioned above, and glycidyl ether-type resins of polyalcohols. Among these resins, the bisphenol A type epoxy resins are most preferably used.

The isobutylene resins include copolymers of isobutylene and maleic anhydride. The maleic anhydride moiety can be also used which is subjected to ammonia modification or imidization, and these preferably have a molecular weight of 10000 or more from the standpoint of the ability to form coating films.

Besides, the lubricating coating agent for plastic working according to the present invention can contain, if necessary, lubricating supplemental components such as oil, soaps, waxes, and extreme pressure agents, rheology adjusters typified by aqueous polymers, swelling clay minerals, and liquid conditioning components such as surfactants.

Vegetable oils, synthetic oils, mineral oils, and the like can be used as the oils for use as the lubricating supplemental component, which can include, for example, palm oils, castor oils, rapeseed oils, machine oils, turbine oils, ester oils, and silicon oils.

The soaps which are alkali metal salts of fatty acids, include, for example, sodium salts and potassium salts of saturated or unsaturated fatty acids having 8 to 22 carbon atoms, such as an octanoic acid, a decanoic acid, a lauric acid, a myristic acid, a palmitinic acid, an eicosanoic acid, an oleic acid, and a stearic acid. Metal soaps include salts of polyvalent metals such as calcium, zinc, magnesium, and barium, with the fatty acids mentioned above.

The waxes include polyethylene waxes, polypropylene waxes, carnauba waxes, and paraffin waxes. Examples of polytetrafluoroethylene include polytetrafluoroethylenes with the degree of polymerization, for example, on the order of from a million to ten millions. Besides, although not classified into the waxes, materials that exhibit lubricating properties can be also used, such as layered-structure amino acid compounds and organic modified clay minerals. These may be used by themselves, or two or more thereof may be used in combination.

Sulfur-based extreme-pressure additives, organic molybdenum-based extreme-pressure additives, phosphorous-based extreme-pressure additives, chlorine-based extreme-pressure additives, etc., can be listed as examples of producing an extreme-pressure effect at the frictional interface during plastic working, such as molybdenum disulfide, tungsten disulfide, tin disulfide, graphite, graphite fluoride, barium sulfate, zinc phosphate, lime, melamine cyanurate, boron nitride, sulfurized olefins, sulfurized esters, sulfites, thiocarbonates, chlorinated fatty acids, phosphoesters, phosphite esters, molybdenum dithiocarbamate (MoDTC), molybdenum dithiophosphate (MoDTP), and zinc dithiophosphate (ZnDTP). These may be used by themselves, or two or more thereof may be used in combination.

It is to be noted that while the black components such as molybdenum disulfide, tungsten disulfide, and tin disulfide, and graphite have been also listed as examples from the standpoint of availability, if necessary, these components contained in large amounts unfavorably cause the lubricating coating film to exhibit a black color, thereby resulting in an indication of black contamination caused by lubricant handling or coating film residue, which falls outside of the spirit of the present invention.

Aqueous polymers, inorganic viscosity adjusters or the like are used for the rheology adjusters as liquid conditioning components, and can be appropriately blended in the treatment liquid of the lubricant or during the synthesis of the suspension of the calcium sulfate hydrate crystal, in order to adjust the liquid viscosity or the like for main purposes such as the stabilization of the dispersed component in the lubricating coating agent for plastic working according to the present invention and the improvement in properties of application to materials to be worked. The aqueous polymers include hydroxyethyl cellulose, carboxymethyl cellulose, amide polyacrylate, sodium polyacrylate, polyvinylpyrrolidone, and polyvinyl alcohol, the inorganic viscosity conditioners include finely-divided silica, bentonite, kaolin, mica, montmorillonite, and hectorite, and both natural products and synthetic products thereof can be used. These may be used by themselves, or two or more thereof may be used in combination.

The lubricating coating agent for plastic working according to the present invention can have surfactants blended for purposes such as the cleaning action on surfaces of materials to be worked and the improvement in wettability. These surfactants are selected depending on molecular structures and HLB, if necessary, and thus optionally selected from non-ionic surfactants, anionic surfactants, ampholytic surfactants, cationic surfactants, etc. These may be used by themselves, or two or more thereof may be used in combination.

Prior to the application of the lubricating coating agent for plastic working according to the present invention, the surface of the target material to be processed is preferably cleaned by pretreatments in the order of cleaning (typically with the use of an alkaline cleaner), water rinsing, descaling (shot blast or acid cleaning with a hydrochloric acid or the like), and water rinsing, for the purpose of achieving a favorable lubricating property. The descaling and then water rinsing may be skipped when there is no adhesion of oxidized scale, or when the agent is used for an intended use requiring oxidized scale. These pretreatments may be carried out by ordinary methods.

The surface of the material to be worked, to which the lubricating coating agent for plastic working according to the present invention is applied, may be subjected to a chemical conversion treatment, an application-type surface treatment or the like, if necessary, for the purposes such as supplement of the rust preventing ability and seizure suppressing ability of the material. Examples of the chemical conversion treatment include an iron phosphate coating treatment, a zinc phosphate coating treatment, a zinc calcium phosphate coating treatment, an iron oxalate coating treatment, an aluminum fluoride coating treatment, and a zircon oxide coating treatment. Examples of the application-type surface treatment include alkali metal salts of boric acids, silicic acids, sulfuric acid, phosphoric acids, and tungstic acids. Besides, such a film as a solid lubricant mechanically coated by a projective method such as blast may be adopted for the surface treatment.

The lubricating coating agent for plastic working according to the present invention is applied on the surfaces of materials to be worked by an ordinary method such as immersion, spraying, flow coating, and brush coating. The application is enough as long as the surface of the material to be worked is adequately coated with the lubricating coating agent for plastic working, and the time for the application is not particularly limited. After the application, there is a need to dry the aqueous lubricating coating agent. The temperature of the material to be worked during the drying is preferably 190° C. or lower (which may be left at normal temperature), and more preferably, typically 60° C. to 150° C. for approximately 10 seconds to 60 minutes. The reason that the temperature of the material to be worked is preferably adjusted to 190° C. or lower is as follows. When the calcium sulfate dihydrate is dried and heated, an anhydrous salt that is soluble (easily hydrated) is, through a hemihydrate, produced at about 190° C. The coating agent herein according to the present invention is aqueous, and thus, in the case of the soluble anhydrous salt, the hydrated state is incorporated into the coating film (in addition, the soluble anhydrous salt is also easily returned to the hydrated state, depending on the humidity in the air). Therefore, the performance is not adversely affected. However, when the material to be worked is dried for a long period of time with the temperature of the material to be worked in excess of 190° C., an anhydrous salt which is less likely to be returned to the hydrated state will be produced, and adversely affect the performance. The above is the reason that the temperature of the material to be worked during the drying is preferably adjusted to 190° C. or lower. Next, the coating mass of the lubricating coating agent for plastic working may be appropriately adjusted based on use such as form to be worked and difficulty, but is preferably 1 g/m$^2$ as a dried coating film from the standpoint of seizure prevention, and typically used in the range of 3 to 50 g/m$^2$. The dried coating amount in excess of 50 g/cm$^2$ is not preferred in the sense of increasing the possibility of adversely affecting the dimensional accuracy of the worked article because the increased generation of coating film residue which is dropped off during forging to cause clogging of the mold, in addition to economic waste due to the saturation of the lubricating effect. It is to be noted that the lubricating coating agent for plastic working according to the present invention may be applied to the surface of the mold, rather than the surface of the material to be worked, or in addition to the surface of the material to be worked.

As an upper layer on a lubricating coating film formed from the lubricating coating agent for plastic working according to the present invention, a protective layer may be provided in a sense that supplements the lubricating property and the rust preventing property. Examples of the component for use in the protective layer can include oils, soaps, metal soaps, and waxes, and one, or two or more thereof can be applied, or used in a form such as a composite layer held by the binder component.

As described above, the scale-like calcium sulfate for use in the lubricating coating agent for plastic working according to the present invention has excellent properties as described above. The above-described scale-like calcium sulfate herein may be subjected to a surface treatment to have further excellent properties. Two embodiments of the scale-like calcium sulfate subjected to a surface treatment will be described below by way of example.

<<First Embodiment>>

First, an object of the first embodiment is to remedy the property of being likely to rust the opposed metal in a humid environment, which becomes problematic when non-black, inexpensive, and easily available calcium sulfate that has excellent lubricating performance as a solid lubricant is used for the surfaces of metal materials such as steels. More specifically, an object of the first embodiment is to provide a calcium sulfate crystal as a solid lubricant, which is unlikely to rust the opposed metal surface even in the case of continuing to have contact with the steel surface or the like in humid environments.

The object mentioned above can be achieved by coating the surface of the scale-like calcium sulfate crystal with a calcium compound that is poorly soluble or insoluble in water. More specifically, a solid lubricant according to the first embodiment is composed of the scale-like calcium sulfate crystal with the crystal surface coated with a calcium compound that is poorly soluble or insoluble in water. As the calcium compound, calcium salts of inorganic acids, calcium salts of organic acids, including polymers and fatty acids, etc. can be used, and the solubility of the calcium compound in water is preferably less than the solubility of calcium sulfate dihydrate in water. It is to be noted that the calcium sulfate dihydrate is defined as 0.2 g dissolved in 100 g of water at ordinary temperature (20° C.) in this specification. Furthermore, it is not necessary for the entire surface of the calcium sulfate crystal to be coated, and it is enough for the surface to be at least partially coated. In addition, the degree of coverage is enough as long as the adhesion of the calcium sulfate crystal can be confirmed by observation under a SEM. It is to be noted that the term of poorly soluble means that the amount of dissolution is 0.2 g or less in 100 g of water at ordinary temperature (20° C.). The term of insoluble means that the amount of dissolution is 0.02 g or less in 100 g of water at ordinary temperature (20° C.).

The calcium sulfate as a solid lubricant, which is widely expected in terms of both performance and cost, can be achieved by coating the surface of the scale-like calcium sulfate crystal with the calcium compound which is poorly soluble or insoluble in water. The present embodiment is extremely useful in industrial applications such as its great economic effects on manufacturing sites, due to the fact that making it possible to apply low-cost and high-performance lubricating coating materials for sliding and lubricants for plastic working, which contain the calcium sulfate, over a large area to various metal materials including iron and steel materials.

<Constituent: Poorly Soluble or Insoluble Calcium Compound in Water, for Coating Scale-Like Calcium Sulfate>

Calcium salts of inorganic acids, calcium salts of organic acids, including polymers and fatty acids, etc. can be used as the calcium compound (coating compound) which is poorly soluble or insoluble in water for coating the surface of the scale-like calcium sulfate crystal in the present embodiment. Such compounds include calcium fluoride, calcium iodate, calcium hydroxide, calcium phosphite, calcium phosphate, calcium monohydrogen phosphate, calcium diphosphate, calcium metaphosphate, calcium carbonate, calcium silicate, calcium metasilicate, calcium tetraborate, calcium tungstate, calcium molybdate, calcium oxalate, calcium stearate, calcium oleate, and besides, aqueous resins or water-dispersible resin emulsions which become insoluble in water with calcium coordinated on a hydrated group such as a carboxyl group. The calcium compound preferably has lower solubility in water as compared with calcium sulfate dihydrate, and more preferably has insolubility in water. Specifically, the solubility (normal temperature), in water, of the calcium compound which is poorly soluble or insoluble in water is preferably less than 0.2 g/100 g, more preferably less than 0.005 g/100 g, and more preferably less than 0.001 g/100 g. In addition, among these compounds, calcium compounds are preferred which have smaller corrosive influences on target metals even when the compounds are somewhat dissolved. Such compounds are, for example, compounds which exhibit a passivation behavior, for example, tungstate salts and molybdate salts.

<Structure>

Figure 8:
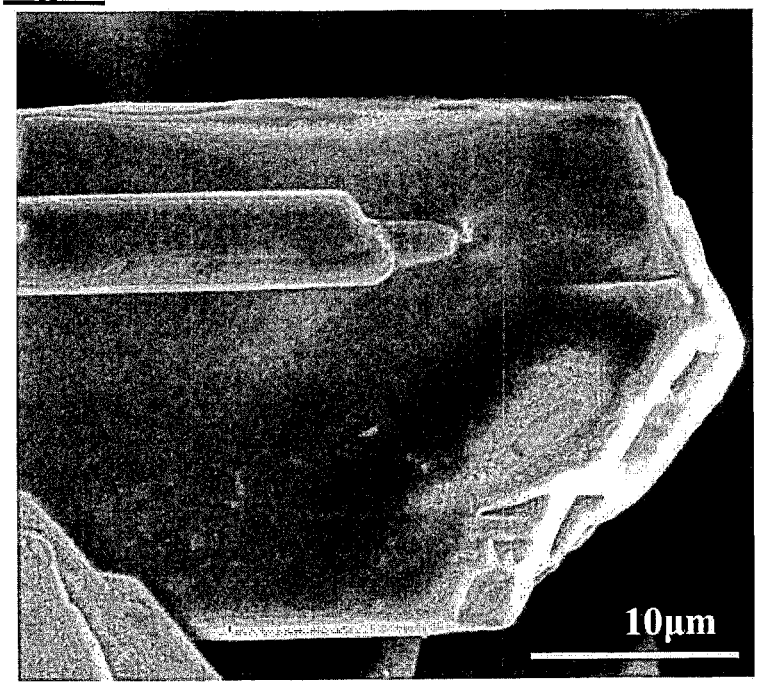
FIG. 8 is a SEM photograph of a calcium sulfate crystal without any deposition.
Figure 9:
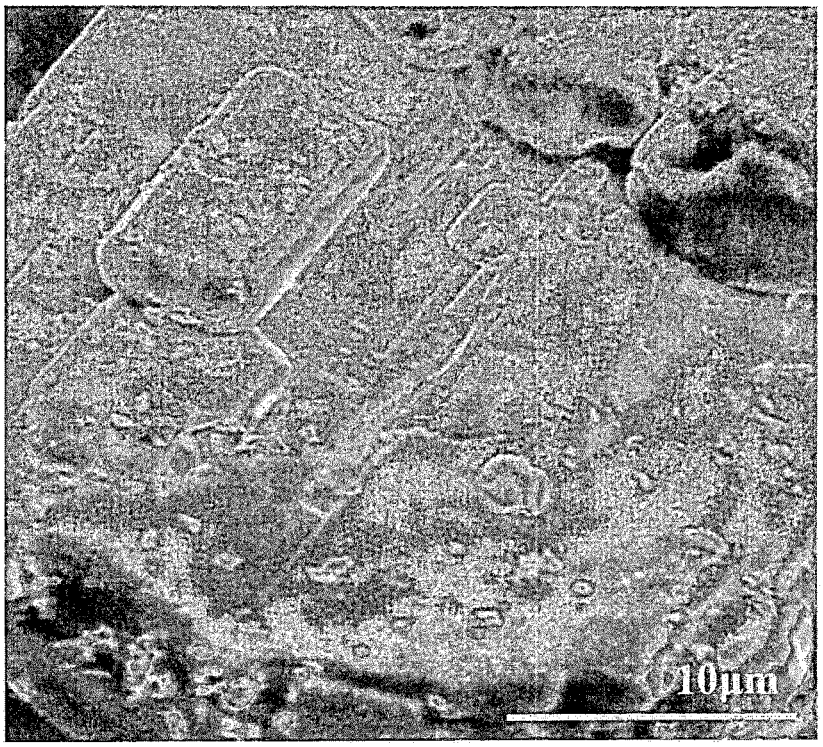
FIG. 9 is a SEM photograph of a calcium sulfate crystal with calcium tungstate deposited (dispersive deposition).
Figure 10:
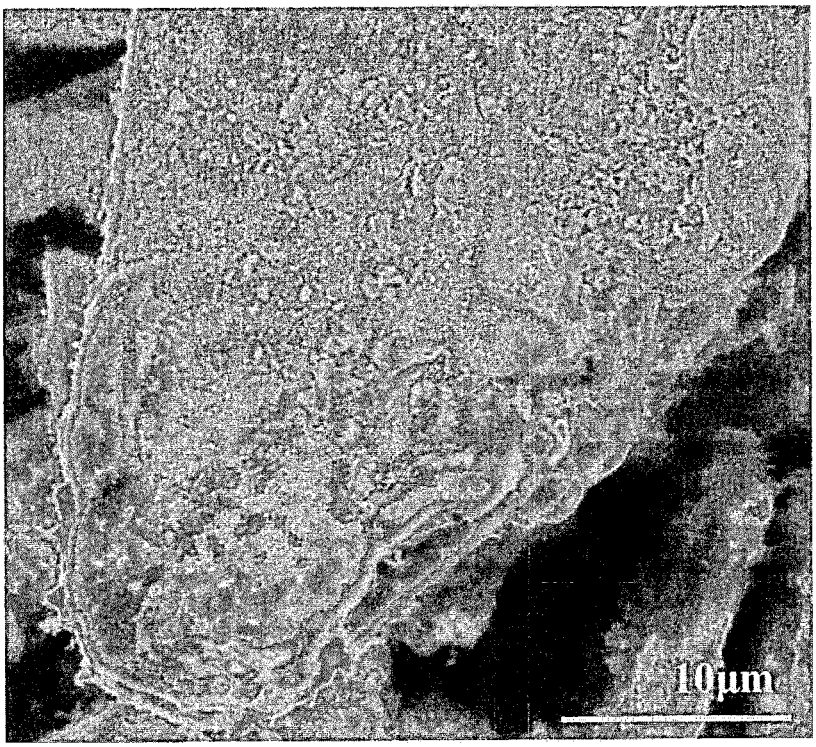
FIG. 10 is a SEM photograph of a calcium sulfate crystal with calcium oxalate deposited (dense deposition).
Figure 11:
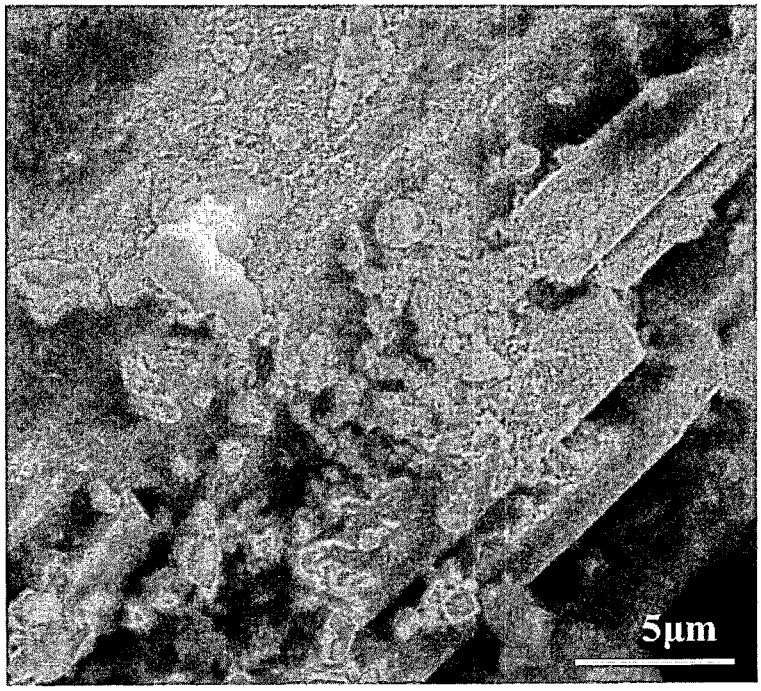
FIG. 11 is a SEM photograph of a calcium sulfate crystal with calcium stearate deposited (dense deposition).

The coated scale-like calcium sulfate according to the present embodiment has a structure of the scale-like calcium sulfate as a core at least partially (for example, sidewalls of plate ends bared) or substantially entirely coated with a coating compound {for example, as compared with an uncoated calcium sulfate crystal (FIG. 8 is an example of an uncoated calcium sulfate), "dispersive deposition" with sparse adhesion of microparticles (FIG. 9. is an example of calcium tungstate); "dense deposition" with higher-density adhesion of deposit than the dispersive deposition (FIG. 10 is an example of calcium oxalate, and FIG. 11 is an example of calcium stearate); "entire deposition" with adhesion of deposit over the entire crystal; and "local deposition" with eccentric adhesion to a portion of the crystal (for example, end surfaces)}. The coating layer of the coating compound herein is not necessarily one layer, and may have two or more multiple layers (layers of different coating compounds). In addition, in this case, the solubility of the upper layer (the solubility in water at ordinary temperatures and pressures) is preferably lower than that of the lower layer. On other hand, even in the case of one layer, the layer may contain multiple types of coating compounds. In addition, in this case, the solubility of at least one coating compound is preferably less than 0.2 g/100 g. Furthermore, the calcium sulfate crystal/calcium salt coating (mass ratio) is preferably 5 to 2000, preferably 10 to 1000, and more preferably 10 to 500. The calcium sulfate crystal/calcium salt coating (mass ratio) herein can be calculated from, for example, the known mass of the calcium sulfate as an object to be worked and the calculated mass value of the calcium salt composed of respective elements quantitated by fluorescent X-rays.

<Production Method>

A method for producing the coated scale-like calcium sulfate according to the present embodiment is characterized by including a step of providing, in water, calcium ions and a component that is bonded to the calcium ions to form a poorly soluble or insoluble calcium compound on the calcium sulfate hydrate crystal, while the scale-like calcium sulfate hydrate crystal is dispersed in the water. In this case, a liquid medium {solution or dispersion (anion dispersion)}containing the component (the component that is bonded to the calcium ions to form a poorly soluble or insoluble calcium compound on the calcium sulfate hydrate crystal) is preferably delivered by drops while agitating into the dispersed water of the calcium sulfate hydrate crystal. In addition, the calcium salt coating is preferably deposited under an alkaline state. It is to be noted that while the approach for making the system alkaline is not particularly limited, it is preferable to make the system alkaline with the use of an alkali metal (in particular, when washing by filtration is not carried out after the production) because ammonia, amines, and the like have a tendency to dissolve the calcium sulfate crystal itself. For example, the coating on the surface of the scale-like calcium sulfate crystal with the calcium compound is typically carried out in such a way that an aqueous liquid obtained by dissolving or dispersing (anion dispersion), in water, one or more selected from alkali metal salts of inorganic acids and organic acids for depositing the calcium compound for the coating is gradually added to the calcium sulfate crystal dispersed while agitation in the water with the calcium ions dissolved therein. While the method for dissolving the calcium ions in water is not limited, calcium may be dissolved by dispersing, into water while agitation, the scale-like calcium sulfate crystal intended for surface coating.

When an aqueous liquid, where one or more selected from alkali metal salts of inorganic acids and organic acids for depositing the calcium compound for coating in the present embodiment is dissolved or dispersed in water, is added into the water with the calcium ions dissolved therein, the inorganic acids and organic acids dissolved or dispersed stably in the water form salts with calcium to insolubilize the salts or destabilize the dispersion thereof in the water, thereby producing a deposition. In this case, when the calcium sulfate crystal is dispersed in the liquid, the insolubilized or destabilized calcium salt is regarded as a deposition onto the surface of the scale-like calcium sulfate crystal.

When the solubility of the calcium sulfate dihydrate crystal as a supply source for calcium ions in water is considered as approximately 0.2 g/100 g, the amount of calcium ion dissolved in the bath is on the order of 0.05 g/100 g. When an aqueous solution of the alkali metal salts of the inorganic acids and organic acids is added thereto, the dissolved calcium is consumed to deposit a calcium compound as a reaction product. When the calcium sulfate crystal is further dissolved to supply calcium ions, the deposition of the calcium compound will be further progressed to cover the surface of the calcium sulfate crystal with the calcium compound.

In the treatment for coating the surface of the scale-like calcium sulfate crystal with the calcium compound which is poorly soluble or insoluble in water, treatment reactions may be developed in a stepwise fashion to coat the surface with two or more layers of calcium compounds, or two or more species of calcium compounds may be formed by simultaneous treatment reactions. The coating condition on the coated surface of the calcium sulfate crystal may vary depending on the types of the calcium compounds, and the coating treatment with two or more calcium compounds is thus expected to enhance the rust preventing effect in a complementary or synergistic manner. For example, it is a first poorly soluble or insoluble salt (for example, a calcium salt of a phosphoric acid) that is incrassated with a focus on easily dissolved portions of the crystal (edges in the case of a scale-like shape) to retard the dissolution of the calcium sulfate, whereas the uncovered portions and the portions with the first poorly soluble or insoluble salt (for example, a calcium salt of a phosphoric acid) deposited are covered with a second poorly soluble or insoluble salt (for example, a calcium salt of a carbonic acid) that is further lower in solubility to enhance the dissolution retarding effect in a synergistic manner. If the reaction order is reversed, it is also conceivable that it will be difficult to deposit the first poorly soluble or insoluble salt (for example, a calcium salt of a phosphoric acid) as an upper layer on the coverage with the second poorly soluble or insoluble salt (for example, a calcium salt of a carbonic acid), thereby making it impossible to achieve the synergistic effect in some cases.

<Properties of Coated Scale-Like Calcium Sulfate>

The scale-like calcium sulfate crystal with a surface coated with the calcium compound which is poorly soluble or insoluble in water suppresses the emission of sulfate ions under humid environment, and thus, even in contact with a metal surface such as steels, making it unlikely to promote rust formation from the opposed metal.

<How to Use (Intended Use)>

The coated scale-like calcium sulfate crystal according to the present embodiment is useful as a solid lubricant. The scale-like calcium sulfate crystal herein, as a solid lubricant according to the present embodiment, subjected to the coating treatment with the calcium compound which is poorly soluble or insoluble in water, can be used in a powdered form through filtration while washing and then drying, or also used directly after the coating treatment in water, or in a slurry form through dispersion in water after filtration while washing. The crystal in the powdered form can be formed into a solid lubricating film by mechanical coating treatment such as projections to surfaces of machine sliding components and surfaces of materials to be worked for plastic working, and also kneaded into lubricating coating materials for sliding and plastic working, or supplied directly or in a mixed state with oil or the like to sliding friction surfaces. The slurry form of the solid lubricant according to the present embodiment dispersed in water can be mixed with a film forming component such as resins and inorganic salts, and thereby made into a lubricating coating agent. In this case, depending on the intended use, it is also possible to appropriately mix organic lubricating components such as soap, waxes, and oils, supplemental anticorrosion additives and viscosity modifiers, etc.

As described above, the solid lubricant according to the first embodiment is a solid lubricant characterized by containing the scale-like calcium sulfate crystal with a crystal surface coated with the calcium compound which is poorly soluble or insoluble in water. For example, in the case of the solid lubricant, the solubility, in water, of the calcium compound which is poorly soluble or insoluble in water is less than 0.2 g/100 g. Furthermore, the method for producing the solid lubricant according to the first embodiment is characterized by including the step of providing, in water, calcium ions and a component that is bonded to the calcium ions to form a poorly soluble or insoluble calcium compound on the scale-like calcium sulfate hydrate crystal, while the calcium sulfate hydrate crystal is dispersed in the water. In addition, the lubricating coating material according to the first embodiment is characterized by containing a solid lubricant containing the calcium sulfate crystal with a crystal surface coated with the calcium compound which is poorly soluble or insoluble in water, a binder component, and a lubricating agent.

<<Second Embodiment>>

Next, an object of the second embodiment is to provide a novel technique for allowing adequate amounts of organic lubricant and solid lubricant to continue to function also in a microscopically homogeneous manner even with the reduction in film thickness by surface enlargement or ironing of steels in plastic working, in a lubricating coating material based on non-black, inexpensive, and easily available calcium sulfate that has excellent lubricating performance as a solid lubricant.

The object mentioned above can be achieved by depositing a fatty acid calcium salt on the surface of a scale-like calcium sulfate crystal, with calcium ions and one or more species of fatty acid components (including fatty acids, fatty acid ions, and fatty acid salts) that can be bonded to the calcium ions in water, under the condition that the calcium sulfate crystal is dispersed in the water. More preferably, the object can be achieved by depositing a fatty acid calcium salt on the surface of the calcium sulfate crystal in such a way that an aqueous solution (or a dispersion) of an alkali metal salt of a fatty acid is added while the calcium sulfate crystal is dispersed in the water with the calcium ions dissolved therein. The fatty acid calcium salt needs to be a calcium salt of a saturated fatty acid or an unsaturated fatty acid having 12 to 20 carbon atoms, and is preferably a calcium salt of a saturated fatty acid or an unsaturated fatty acid having 14 to 18 carbon atoms.

The deposition, on the surface of the scale-like calcium sulfate crystal, of the fatty acid calcium salt as an organic lubricant that has an excellent friction reducing ability makes it possible to provide a lubricating coating material that is even microscopically homogeneous without eccentrically locating the calcium sulfate as a solid lubricant that serves to suppress seizure at a friction surface and the organic lubricant that functions to reduce frictions. The present embodiment is extremely useful in industrial applications because of its great economic effects on manufacturing sites, such as making it possible to extensively use low-cost and high-performance lubricating coating materials for sliding and lubricants for plastic working, which contain the calcium sulfate, even in further severer friction surface environments.

<Constituent: Fatty Acid Calcium Modifying Calcium Sulfate Crystal>

Calcium salts of saturated fatty acids or unsaturated fatty acids having 12 to 20 carbon atoms are preferred as the fatty acid calcium salt deposited on the surface of the calcium sulfate crystal in the present embodiment. Such calcium salts include calcium laurate, calcium myristate, calcium pentadecylate, calcium palmitate, calcium palmitoleate, calcium margarate, calcium stearate, calcium isostearate, calcium oleate, calcium vaccenate, calcium linoleate, calcium (9,12,15)-linolenate, calcium (6,9,12)-linolenate, calcium eleostearate, calcium tuberculostearate, calcium arachidate, and calcium arachidonate. It is to be noted that linear molecular structures, above all, having 14 to 18 carbon atoms are preferred when calcium salts are selected which are particularly favorable in friction reducing ability as organic lubricants. In this case, one of the fatty acids may be selected, or two or more thereof may be combined as the fatty acid species for modification.

<Composition in Highly Lubricating Calcium Sulfate Crystal>

The composition in the highly lubricating calcium sulfate crystal according to the present embodiment, specifically, the quantitative ratio (mass ratio) of scale-like calcium sulfate crystal/fatty acid calcium salt deposited on the surface of the calcium sulfate crystal is preferably 20 or less, more preferably 4 or less, and further preferably 2 or less. It is to be noted that the lower limit is preferably 0.5, and more preferably 1. The measurement of the quantitative ratio herein is made, for example, in accordance with the following procedure. First, about 20 g of a dry powder of the scale-like calcium sulfate crystal with a fatty acid calcium salt deposited on the surface thereof is weighed, and immersed for 30 minutes in a boiled mixed solvent (6 parts of isopropyl alcohol, 3 parts of heptane, and 1 part of ethyl cellosolve). Then, the crystal is subjected to filtration, and thereafter weighed again. The decrease in weight between before and after the immersion in the mixed solvent is regarded as the amount of coating with the fatty acid calcium salt to calculate the mass ratio between the calcium sulfate crystal and the fatty acid calcium salt deposited on the surface of the calcium sulfate crystal.

<Structure of Highly Lubricating Calcium Sulfate Crystal>

Figure 13:
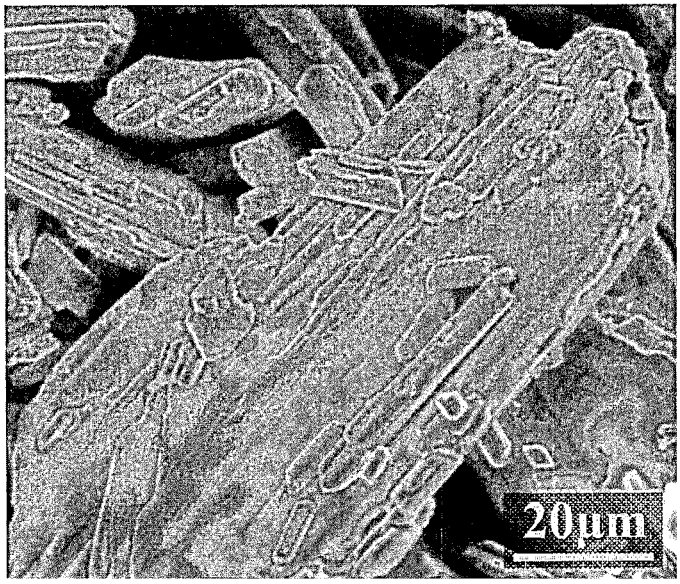
FIG. 13 is a SEM photograph of an uncoated calcium sulfate.
Figure 14:
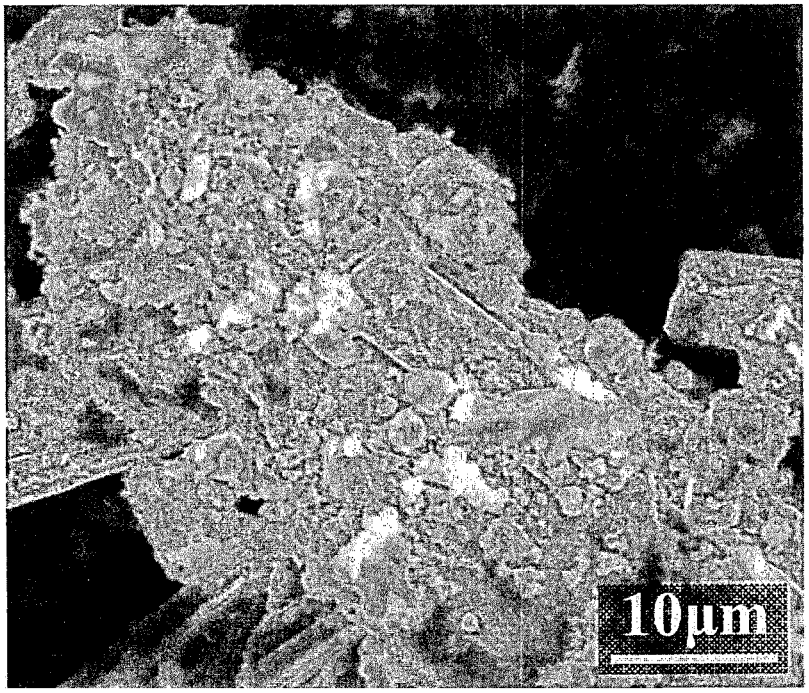
FIG. 14 is a SEM photograph of a calcium sulfate coated with a calcium salt of a fatty acid.

The highly lubricating calcium sulfate crystal in the present embodiment has a structure of the calcium sulfate as a core at least partially (for example, sidewalls of plate ends bared) or substantially entirely coated with the fatty acid calcium salt. Further, FIG. 13 is a SEM photograph of an uncoated calcium sulfate, whereas FIG. 14 is a SEM photograph of a calcium sulfate coated with a calcium salt of a fatty acid (stearic acid). The layer of the fatty acid calcium salt herein may have one layer, or two or more multiple layers (layers of different fatty acids). Alternatively, even in the case of having one layer, the layer may contain different species of fatty acids.

<Method for Producing Highly Lubricating Calcium Sulfate Crystal>

The method for producing the highly lubricating calcium sulfate crystal according to the present embodiment includes a step of depositing a fatty acid calcium salt on the surface of a scale-like calcium sulfate crystal, with calcium ions and one or more species of fatty acid components that can be bonded to the calcium ions in water, under the condition that the calcium sulfate hydrate crystal is dispersed in the water with the calcium ions dissolved therein. In this case, the fatty acid components may be dissolved or dispersed in the water (for example, fatty acids, fatty acid ions, or fatty acid salts). The fatty acids derived from the fatty acid components are bonded to the calcium ions to deposit, on the surface of the calcium sulfate crystal, a fatty acid calcium salt that is poorly soluble or insoluble in water. It is to be noted that the term "poorly soluble" in this specification means that the solubility (ordinary temperatures) in water is 0.2 g/100 g or less. In this case, the liquid medium (solution or dispersion) containing the component (the fatty acid component bonded to the calcium ion to form a salt) is preferably delivered by drops while agitating into the dispersed water of the scale-like calcium sulfate hydrate crystal. Furthermore, the reaction under an alkaline state is preferred. For example, the deposition of the fatty acid calcium salt onto the surface of the calcium sulfate crystal is typically carried out in such a way that an aqueous liquid obtained by dissolving or dispersing, in water, one or more selected from alkali metal salts of fatty acids for depositing the fatty acid calcium salt is gradually added to the calcium sulfate crystal dispersed while agitation in the water with the calcium ions dissolved therein. While the method for dissolving the calcium ions in water is not limited, calcium may be dissolved by dispersing, into water while agitation, the calcium sulfate crystal to be subjected to deposition onto the surface thereof. It is to be noted that it is difficult to dissolve or disperse, in cold water, in particular, those having a lot of carbon atoms or almost linear structures, and thus, in those cases, those are dissolved or dispersed appropriately with the use of hot water. In those cases, the temperature of aqueous slurry obtained by dispersing the calcium sulfate crystal to be subjected to deposition onto the surface thereof is also preferably adapted in the same way. For example, as for fatty acid components solidified at ordinary temperatures, the temperature of the aqueous slurry with the scale-like calcium sulfate crystal dispersed therein is preferably adapted to fall within the range of ±10° C. on the basis of the aqueous liquid temperature of the fatty acid component (depending on the component, the temperature at which the fatty acid component is dissolved, for example, 80 to 90° C.).

When an aqueous liquid of one or more selected from alkali metal salts of fatty acids dissolved or dispersed in water for depositing the fatty acid calcium salt is added into the water with the calcium ions dissolved therein, the fatty acid dissolved or dispersed stably in the water forms a salt with calcium to insolubilize the salt or destabilize the dispersion thereof in the water, thereby producing a deposition. In this case, when the calcium sulfate crystal is dispersed in the liquid, the insolubilized or destabilized calcium salt is regarded as a deposition onto the surface of the calcium sulfate crystal. In this case, the alkali metal of the fatty acid may partially remain without forming any salt with calcium, and the salt may be deposited in a mixed state with other organic lubricants such as a wax.

When the solubility of the calcium sulfate dihydrate crystal as a supply source for calcium ions in water is considered as approximately 0.2 g/100 g, the amount of calcium ion dissolved in the bath is on the order of 0.05 g/100 g. When an aqueous solution or an aqueous dispersion of the alkali metal salt of the fatty acid is added thereto, the dissolved calcium is consumed to deposit a fatty acid calcium compound as a reaction product. When the calcium sulfate crystal is further dissolved to supply calcium ions, the deposition of the fatty acid calcium compound will be further progressed to cover the surface of the calcium sulfate crystal with the fatty acid calcium compound.

In the treatment for depositing the fatty acid calcium salt onto the surface of the scale-like calcium sulfate crystal, treatment reactions may be developed in a stepwise fashion to coat the surface with two or more layers of fatty acid calcium salts, or two or more species of fatty acid calcium salts may be deposited by simultaneous treatment reactions. The condition on the coated surface of the calcium sulfate crystal may vary depending on the types of the fatty acid calcium compounds, and the coating treatment with two or more fatty acid calcium salts is thus expected to enhance the lubricating performance in a complementary or synergistic manner.

<Properties of Highly Lubricating Calcium Sulfate Crystal>

The calcium sulfate crystal with the fatty acid calcium salt deposited on the surface thereof, which is structured to hold calcium soap that has crystals themselves as an organic lubricant, is a so-called hybrid-type lubricating crystal that achieves a balance between the seizure suppressing ability and the friction reducing ability. This approach can increase the amount of the organic lubricant blended for the calcium sulfate crystal as a solid lubricant without degrading various types of performance in lubricating coating materials in the case of industrial uses, and also substantially reduces unevenness or the like of functions such as the friction reducing function and the seizure suppressing function, which is caused by eccentric locations for each component prompted by a reduction in film thickness, even in environments in which lubricating coating are forced to be extremely reduced in film thickness due to the enlarged surface of the material to be coated, such as in cold forging, because of the hybrid with the organic lubricant on a crystal unit level. It is to be noted that the term "highly lubricating" used in this specification means that the shear friction factor is less than 0.2. The shear friction factor herein refers to a value obtained with the use of a ring compression test as a kind of forging-type friction testing method {Male, A. T. and Cockcroft, M. G.: J. of the Inst. of Metals, 93 (1964), 38-46}. Further, the shear friction factor of untreated calcium sulfate is greater than 0.25.

<How to Use (Intended Use)>

The highly lubricating calcium sulfate crystal according to the present embodiment is useful as a solid lubricant. The scale-like calcium sulfate crystal with the fatty acid calcium salt deposited on the surface thereof herein as a highly lubricating solid lubricant according to the present embodiment can be used in a powdered form through filtration while washing and then drying, or also used directly after the treatment for deposition in water, or in a slurry form through dispersion in water after filtration while washing, or the like. The crystal in the powdered form can be formed into a solid lubricating film by mechanical coating treatment such as projections to surfaces of machine sliding components and surfaces of materials to be worked for plastic working, and also kneaded into lubricating coating materials for sliding and plastic working, or supplied directly or in a mixed state with oil or the like to sliding friction surfaces. Further, the calcium sulfate crystal with the fatty acid calcium salt deposited on the surface thereof is also easy to use in combination with oil-based lubricants, because the crystal improves wettability with hydrophobic substances such as oil. The slurry form of the solid lubricant according to the present embodiment dispersed in water can be mixed with a film forming component such as resins and inorganic salts, and thereby made into a lubricating coating agent. In this case, depending on the intended use, it is also possible to appropriately mix other organic lubricating components such as soap, waxes, and oils, supplemental anticorrosion additives and viscosity modifiers, etc. It is to be noted that the content of surfactant in a treatment agent containing the solid lubricant according to the present embodiment is preferably 5 mass % or less, and more preferably 3 mass % or less on the basis of the total solid content of the treatment agent. In addition, the content of organic lubricant in a treatment agent containing the solid lubricant according to the present embodiment is preferably 50 mass % or less, and more preferably 30 mass % or less on the basis of the fatty acid calcium salt deposited on the solid lubricant.

As described above, the solid lubricant according to the second embodiment is characterized by the fatty acid calcium salt deposited on the surface of the scale-like calcium sulfate crystal. In this case, the fatty acid calcium salt has, for example, 12 to 20 carbon atoms. In addition, the method for producing the solid lubricant according to the second embodiment includes the step of depositing a fatty acid calcium salt on the surface of the calcium sulfate crystal, with calcium ions and one or more species of fatty acid components that can be bonded to the calcium ions in water, under the condition that the calcium sulfate crystal is dispersed in the water with the calcium ions dissolved therein. Furthermore, the lubricating coating material according to the second embodiment contains the calcium sulfate with the fatty acid calcium salt deposited on the crystal surface, a binder component, and a lubricating agent.

[Examples]

The present invention as well as advantageous effects thereof will be further specifically described below with reference to both examples of the present invention and comparative examples. It is to be noted that the present invention is not to be considered limited by these examples.

(1) Production of Coating Agent

Lubricating coating agents for plastic working according to respective examples and comparative examples were produced in accordance with the mass ratios in terms of solid content as shown in Table 1. The solid content concentrations of treatment liquids for each lubricating coating agent were adjusted appropriately by mixing pure water so that the deposition of a film formed by application to a material to be worked through immersion and then by drying was about 5 $g/m^2$. It is to be noted that the preparation method of suspensions in the table represents methods for creating a suspension of each solid lubricating material dispersed in water for using in an intermediate step on manufacturing the coating agents, and here are details thereof.

(2) Preparation Methods for Suspensions

<Preparation Method a> To 950 g of water, 50 g of a commercially available solid lubricating material powder was added while agitation with the use of a propeller agitator (rotation speed: 800 rpm). After the completion of the addition, shear agitation with the use of a homomixer rotating at 2000 rpm was continued for 30 minutes to provide a suspension.

<Preparation Method b> To 749 g of a 16.4 mass % sulfuric acid aqueous solution, 251 g of a suspension obtained by mixing calcium carbonate in water while agitation at a concentration of 50 mass % was gradually added while agitation over 30 minutes with the use of a propeller agitator rotating at 800 rpm. It is to be noted that the liquid temperature was about 40° C. after the completion of the addition. Through the further addition of sodium hydroxide, an adjustment was made to pH 7, and the propeller agitation was further continued for 30 minutes to provide a suspension. The shape of the crystal obtained by drying the suspension and observed under a scanning electron microscope was a columnar shape of 2.5 μm in average thickness, and the intensity ratio of (020) plane/(021) plane was 2.3 which was obtained from an analysis result by an X-ray diffraction method (using PTFE, as the case may be).

<Preparation Method c> Under a condition controlled to a liquid temperature of 10° C. or lower with the use of a cooling machine, to 450 g of a suspension obtained by mixing 45 g of calcium carbonate in 405 g of water while agitation, 550 g of a 8.0 mass % sulfuric acid aqueous solution was added over 5 minutes while agitation with the use of a propeller agitator rotating at 800 rpm. After further continuing the propeller agitation for 30 minutes, an adjustment was made to pH 7 through the addition of sodium hydroxide to provide a suspension. The shape of the crystal obtained by drying the suspension and observed under a scanning electron microscope was a scale-like shape of 1.2 μm in average thickness, and the intensity ratio of (020) plane/(021) plane was 21.5 which was obtained from an analysis result by an X-ray diffraction method.

<Preparation Method d> To 550 g of a 5.2 mass % sulfuric acid aqueous solution, 450 g of a suspension obtained by mixing 30 g of calcium carbonate with respect to 420 g of water while agitation was gradually added while agitation over 10 minutes with the use of a propeller agitator rotating at 800 rpm. It is to be noted that the liquid temperature was about 30° C. after the completion of the addition. Through the further addition of sodium hydroxide, an adjustment was made to pH 7, and the propeller agitation was further continued for 30 minutes to provide a suspension. The shape of the crystal obtained by drying the suspension and observed under a scanning electron microscope was a scale-like shape of 0.8 μm in average thickness, and the intensity ratio of (020) plane/(021) plane was 119.9 which was obtained from an analysis result by an X-ray diffraction method. Further, FIG. 3 is a chart obtained when a calcium sulfate hydrate crystal obtained by this method is analyzed by the X-ray diffraction method.

(3) Solid Lubricating Material

α. calcium sulfate dihydrate (L* value=90 or more)

β. non-hydrate of calcium sulfate (L* value=90 or more) (anhydrous salt obtained by dehydration of the dihydrate at 250° C.)

χ. molybdenum disulfide (L* value=46)

δ. Graphite (L* value=39)

ε. melamine cyanurate (L* value=90 or more)

ϕ. zinc phosphate (L* value=90 or more)

γ. boron nitride (L* value=90 or more)

(4) Binder Component a. potassium tetraborate b. sodium sulfate c. sodium citrate d. phenolic resin: phenol novolac aminated for water solubility (molecular weight: 500 to 6000)

e. acrylic resin: resin obtained by emulsion polymerization of, with polyoxyethylene alkyl phenyl ether, a copolymerization product from methyl methacrylate and n-butyl acrylate (molecular weight: 150,000 or more)

f. isobutylene resin: copolymerization product from isobutylene and maleic anhydride (molecular weight: 90,000)

(5) Additives

I. calcium stearate

II. zinc stearate

III. polyethylene wax

IV. organic-modified synthetic mica: distearyldimethylammonium chloride supported between layers of hectorite V. graphitized carbon black: from Mitsubishi Chemical Corporation VI. aqueous dispersion of zinc phosphate: from Nihon Parkerizing Co., Ltd.

VII. synthesized hectorite

VIII. potassium phosphite (6) Pretreatment and Coating Treatment

The lubricating coating treatment for test pieces for plastic working performance evaluation according to Examples 1 to 13 and Comparative Examples 1 to 12 was carried out in such a way that respective lubricating coating agents prepared at the solid content ratios in Table 1 with water as a medium were applied through immersion to the materials to be worked, and then dried. It is to be noted that the solid content concentrations of the treatment liquids for the lubricating coating agents were adjusted appropriately by using pure water so that the deposition of a film formed was about 5 g/m$^2$. In addition, SWRM8 (tensile strength: 462 MPa), cylinders of ϕ 11.95 mm×28.0 mm were used as the materials to be worked.

i Scale Removal: shot blast (media: alumina 100 μm).

Degreasing: degreasing agent (FINECLEANER™ 4360, from Nihon Parkerizing Co., Ltd.), concentration: 20 g/L, temperature: 60° C., immersion: 10 minutes.

Water Rinsing: tap water, ordinary temperature, spray for 30 seconds.

ii. Surface Treatment 1 (carried in Example 11 and Comparative Example 4): a 5 mass % aqueous solution of sodium silicate ($Na_2O$-$3SiO_2$) was applied by spray coating, and then subjected to hot-air drying at 200° C. to form coating films of about 1 g/m$^2$.

iii. Surface Treatment 2 (carried in only in Example 12): the materials were immersed for 10 minutes in a chemical conversion treatment agent of zinc phosphate (PALBOND™ 181X from Nihon Parkerizing Co., Ltd.) with a concentration of 90 g/L at a temperature of 80° C., and then subjected to water rinsing, and drying with an air dryer for the removal of adhering moisture. The deposition of the phosphate coating film was about 5 g/m$^2$.

iv. Lubricating Coating Treatment: treatment liquids for each lubricating coating agent, 40° C., immersion for 30 seconds.

v. Drying: hot-air drying at 100° C. for 10 minutes.

vi. Oiling (carried out only in Example 2 and Comparative Example 1): oiling by immersion in a palm oil.

TABLE 1

| | | Suspension | | | Binder Component | | Additives | |
|---|---|---|---|---|---|---|---|---|
| | | Solid Lubricating Material | Preparation Method | % | Species of Component | % | Species of Component | % |
| Example | 1 | α | d | 90 | d | 5 | I | 5 |
| | 2 | α | d | 98 | e | 2 | — | — |
| | 3 | α | d | 70 | f | 10 | II + III (3:1) | 20 |
| | 4 | α | d | 60 | a | 20 | IV | 20 |
| | 5 | α | d | 40 | b | 40 | I + V (1:3) | 20 |
| | 6 | α | d | 20 | c | 20 | II + VI (1:1) | 60 |
| | 7 | α | d | 10 | d | 60 | I + III (2:1) | 30 |
| | 8 | α | d | 6 | e | 70 | II + VII (5:1) | 24 |
| | 9 | α | c | 70 | e | 10 | III + VII (3:1) | 20 |
| | 10 | α | c | 70 | f | 15 | I | 15 |
| | 11 | α | c | 90 | — | — | I | 10 |
| | 12 | α | c | 70 | — | — | II | 30 |
| | 13 | α | c | 40 | b | 40 | I + V (1:3) | 20 |

TABLE 1-continued

| | | Suspension | | | Binder Component | | Additives | |
|---|---|---|---|---|---|---|---|---|
| | | Solid Lubricating Material | Preparation Method | % | Species of Component | % | Species of Component | % |
| Comparative Example | 1 | α | a | 98 | e | 2 | — | — |
| | 2 | α | a | 60 | a | 20 | II | 20 |
| | 3 | α | b | 90 | d | 5 | I | 5 |
| | 4 | α | b | 90 | — | — | I | 10 |
| | 5 | α | d | 3 | e | 67 | II | 30 |
| | 6 | α | d | 3 | e | 47 | I + VI (1:1) | 50 |
| | 7 | β | a | 70 | f | 15 | I | 15 |
| | 8 | χ | a | 70 | e | 15 | II | 15 |
| | 9 | δ | a | 70 | e | 15 | II | 15 |
| | 10 | ϵ | a | 70 | f | 15 | I | 15 |
| | 11 | ϕ | a | 70 | f | 15 | I | 15 |
| | 12 | γ | a | 70 | f | 15 | I | 15 |

※ The calcium sulfate hydrate crystal powder with the (020)/(021) intensity ratio of 3:7 was used in Comparative Examples 1 and 2.

(6) Evaluation

Suspension Stability:

In a cylindrical glass bottle of 35 mm in diameter, 50 mL of a liquid adjusted to a solid content of 3 mass % by diluting, with pure water, a suspension of the solid lubricating material dispersed was left and stored at 40° C. for 24 hours, and the height of the sedimentation layer in the bottle was measured to evaluate the stability of the suspension. The increased height of the sedimentation layer can be evaluated as an increase in the viscosity of the structure developed in the sedimentation layer, which is advantageous for liquid stability in the case of blending particles of the solid lubricant into the treatment liquid for the lubricating coating agent. On the other hand, the decreased height of the sedimentation layer facilitates the sedimentation of the solid lubricating particles dispersed in the treatment liquid for the lubricating coating agent, and also promotes aggregation between the solid lubricating particles in the sedimentation layer, thus making it impossible to keep the homogeneous distribution in the lubricating coating film, and also making the lubricating performance unstable. It is to be noted that even in the case of an evaluation "x", it is possible to use the suspension as long as redispersion is carried out by mandatory agitation, while the use is not practical.

<Evaluation Criteria>

○: sedimentation layer height of 15 mm or more.

Δ: sedimentation layer height of 10 mm or more and less than 15 mm.

×: sedimentation layer height of less than 10 mm.

Work Environment:

The work environments in the work of applying the lubricating coating agents for plastic working to the materials to be worked were subjected to sensory evaluation on the basis of the following evaluation criteria.

<Evaluation Criteria>

○: the coater or operator is not contaminated with black in the work of applying the lubricating coating agent.

×: the coater or operator contaminated is with black in the work of applying the lubricating coating agent.

Figure 5:
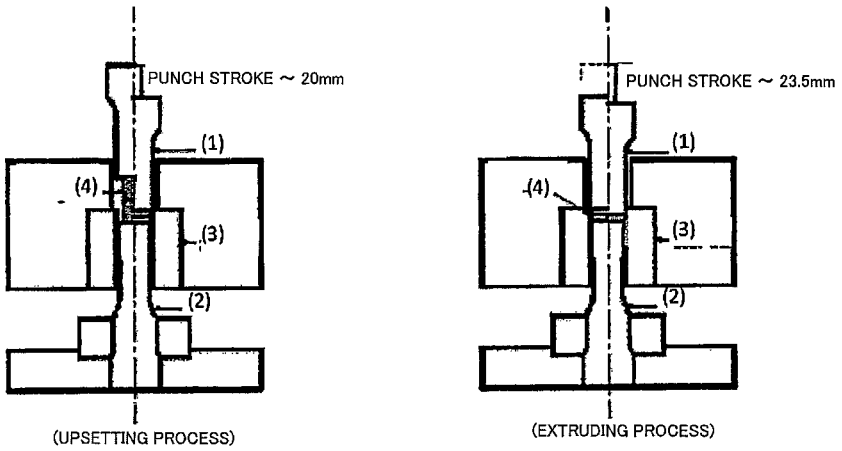
FIG. 5 is a diagram of the principle of working mold for conducting a plastic working performance evaluation.

Plastic Working Performance:

The evaluation of performance as the lubricating coating agent for plastic working was conducted by a method for evaluating a lubricating coating film for forging according to the invention in Japanese Patent Application Laid-Open No. 2010-94731, which is a seizure promoting test of simulating highly difficult multistage forging by working continuously from upsetting to extruding in one stroke. FIG. 5 shows the principle of the test method. The extruding for forming into a cup shape was carried out until the bottom pressure of the worked article reached 4.5 mm, and the performance evaluation was conducted by observing the inner wall surface of the cup and the surface of the mold on the basis of the following evaluation criteria focused on the seizure suppressing ability. It is to be noted that the evaluation of "Δ" or higher is considered to have a practical level of seizure suppressing ability.

<Evaluation Criteria>

⊙: almost no scratch or seizing observed on the inner wall surface of the cup-like molded product and the mold surface.

○: scratch or seizing less than 20% in terms of area ratio, observed on the inner wall surface of the cup-like molded product and the mold surface.

Δ: scratch or seizing in the range of 20 to 50% in terms of area ratio, observed on the inner wall surface of the cup-like molded product and the mold surface.

×: scratch or seizing in excess of 50% in terms of area ratio, observed on the inner wall surface of the cup-like molded product and the mold surface.

The evaluation results described above are shown in FIG. 2. As is clear from Table 2, Examples 1 to 13 of the lubricating coating agents for plastic working according to the present invention have achieved practical levels in all of the evaluation items. On the other hand, the suspension stability has failed to achieve the practical level in Comparative Examples 1 to 4 using the calcium sulfate powders with the crystal shapes outside the scope of the present invention and Comparative Examples 7 to 12 using the solid lubricating materials outside the scope of the present invention. Comparative Examples 5 and 6 with the contents of calcium sulfate hydrate outside the scope of the present invention, Comparative Example 7 using the non-hydrate in place of the calcium sulfate hydrate, or Comparative Examples 10 and 12 using the other non-black solid lubricating materials have failed to achieve the practical level of plastic working performance. In addition, Comparative Examples 8 and 9 with the plastic working performance developed to the practical level with the use of molybdenum disulfide or graphite significantly contaminated the work environments with the black in the application and plastic working test, which fall outside the spirit of the present invention.

TABLE 2

| | | Suspension Stability | Work Environment | Plastic Working Performance |
|---|---|---|---|---|
| Example | 1 | ○ | ○ | ⊙ |
| | 2 | ○ | ○ | ○ |
| | 3 | ○ | ○ | ⊙ |
| | 4 | ○ | ○ | ⊙ |
| | 5 | ○ | ○ | ○ |
| | 6 | ○ | ○ | ○ |
| | 7 | ○ | ○ | Δ |
| | 8 | ○ | ○ | Δ |
| | 9 | Δ | ○ | ⊙ |
| | 10 | Δ | ○ | ⊙ |
| | 11 | Δ | ○ | ⊙ |
| | 12 | Δ | ○ | ⊙ |
| | 13 | Δ | ○ | Δ |
| Comparative Example | 1 | X | ○ | X |
| | 2 | X | ○ | X |
| | 3 | X | ○ | X |
| | 4 | X | ○ | X |
| | 5 | ○ | ○ | X |
| | 6 | ○ | ○ | X |
| | 7 | X | ○ | X |
| | 8 | X | X | ⊙ |
| | 9 | X | X | Δ |
| | 10 | X | ○ | X |
| | 11 | X | ○ | Δ |
| | 12 | X | ○ | X |

<<Examples of Coated Scale-Like Calcium Sulfate>>

I. Production of Solid Lubricant

<Example 1A of Production of Solid Lubricant>

Under a condition controlled to a liquid temperature of 10° C. or lower with the use of a cooling machine, to 450 g of a suspension obtained by mixing 45 g of calcium carbonate in 405 g of water while agitation, 550 g of a 8.0 mass % sulfuric acid aqueous solution was added over 5 minutes while agitation with the use of a propeller agitator rotating at 800 rpm. The propeller agitation was further continued for 30 minutes to complete the synthesis. The thus synthesized calcium sulfate slurry was subjected to filtration and drying to obtain a powder of scale-like calcium sulfate crystals of 1.2 μm in average thickness. It is to be noted that the intensity ratio of (020) plane/(021) plane was 21.5, which was obtained from the result of analyzing the calcium sulfate crystal by an X-ray diffraction method. Slurry was prepared by mixing 20 g of the scale-like calcium sulfate powder in 70 g of pure water while agitation, and in the slurry, 10 g of a 3 mass % sodium tungstate aqueous solution (intended for the deposition of a tungstic acid calcium salt (solubility in water: 0.0024 g/100 g)) was gradually delivered by drops while agitation with a magnetic stirrer. Thereafter, the agitation was continued for 10 minutes to complete the treatment for coating the calcium sulfate crystal. The slurry of the calcium sulfate powder subjected to the coating treatment was subjected to filtration with filter paper, then washed by filtration for 10 minutes with the use of flowing pure water, and dried in a hot-air drying machine at 100° C. to complete the production of a solid lubricant 1A. From electron microscopic observation of the obtained solid lubricant 4, an aggregate deposition of needle crystals of 0.1 μm or less is observed which is deposited on the entire surface of the calcium sulfate crystal (mass ratio of calcium sulfate crystal/calcium salt deposition=86).

<Example 2A of Production of Solid Lubricant>

To 550 g of a 5.2 mass % sulfuric acid aqueous solution, 450 g of slurry obtained by mixing 30 g of calcium carbonate with respect to 420 g of water while agitation was gradually added over 10 minutes while agitation with the use of a propeller agitator rotating at 800 rpm. It is to be noted that the liquid temperature was about 30° C. after the completion of the addition. The thus synthesized calcium sulfate slurry was subjected to filtration and drying to obtain a powder of scale-like calcium sulfate crystals of 0.8 μm in average thickness. It is to be noted that the intensity ratio of (020) plane/(021) plane was 119.9, which was obtained from the result of analyzing the calcium sulfate crystal by an X-ray diffraction method. Slurry was prepared by mixing 20 g of the scale-like calcium sulfate powder in 70 g of pure water while agitation, and in the slurry, 10 g of a 1.5 mass % sodium oxalate aqueous solution (intended for the deposition of an oxalic acid calcium salt (solubility in water: 0.0007 g/100 g)) was gradually delivered by drops while agitation with a magnetic stirrer. Thereafter, the agitation was continued for 10 minutes to compete the treatment for coating the calcium sulfate crystal. The slurry of the calcium sulfate powder subjected to the coating treatment was subjected to filtration with filter paper, then washed by filtration for 10 minutes with the use of flowing pure water, and dried in a hot-air drying machine at 60° C. to complete the production of a solid lubricant 2A. From electron microscopic observation of the obtained solid lubricant 6, an aggregate deposition of microcrystals of less than 0.1 μm is observed which is densely deposited on the entire surface of the calcium sulfate crystal (mass ratio of calcium sulfate crystal/calcium salt deposition=192).

<Comparative Example 1a of Production of Solid Lubricant>

In 70 g of pure water, 20 g of a calcium sulfate dihydrate powder (first-class reagent, from KISHIDA CHEMICAL Co., Ltd.) was mixed while agitation to obtain slurry, and in the slurry, 10 g of a 2 mass % sodium bromide aqueous solution was gradually delivered by drops while agitation with a magnetic stirrer. Thereafter, the agitation was continued for 10 minutes to complete the treatment for coating the calcium sulfate crystal. The slurry of the calcium sulfate powder subjected to the coating treatment was subjected to filtration with filter paper, then washed by filtration for 10 minutes with the use of flowing pure water, and dried in a hot-air drying machine at 60° C. to complete the production of a solid lubricant 1a. It is to be noted that the solubility of the calcium bromide in water is 143 g/100 g, which is not a calcium compound required in the present embodiment.

<Comparative Example 2a of Production of Solid Lubricant>

In 70 g of pure water, 20 g of a calcium sulfate dihydrate powder (first-class reagent, from KISHIDA CHEMICAL Co., Ltd.) was mixed while agitation to obtain slurry, and in the slurry, 10 g of a 2 mass % sodium lactate aqueous solution was gradually delivered by drops while agitation with a magnetic stirrer. Thereafter, the agitation was continued for 10 minutes to complete the treatment for coating the calcium sulfate crystal. The slurry of the calcium sulfate powder subjected to the coating treatment was subjected to filtration with filter paper, then washed by filtration for 10 minutes with the use of flowing pure water, and dried in a hot-air drying machine at 60° C. to complete the production of a solid lubricant 2a. It is to be noted that the solubility of the calcium lactate in water is 5 g/100 g, which is not a calcium compound required in the present invention.

II. Corrosion Resistance Evaluation

The respective solid lubricants produced by carrying out the coating treatment for the calcium sulfate crystal in the section I and a calcium sulfate dihydrate powder (a first-class reagent from KISHIDA CHEMICAL Co., Ltd.) by way of comparison were adjusted with pure water so that the respective solid content concentrations were 10 mass %, and a polyvinyl alcohol aqueous solution was added thereto so that the mass ratio of calcium sulfate/polyvinyl alcohol was 5. Then, a sodium hydroxide aqueous solution was added so that the respective adjusted liquids reached pH 10, thereby providing treatment liquids for corrosion resistance evaluation. Each treatment liquid for corrosion resistance evaluation was applied onto a cold-rolled steel sheet subjected to cleaning for degreasing so that the coating mass after moisture volatilization was 10 g/m$^2$, and rapidly dried by hot air to create each test piece for corrosion resistance evaluation. For the corrosion resistance evaluation of the created test samples, the rust formation after leaving the test pieces for 120 hours in a constant temperature and humidity bath at a temperature of 30° C. and humidity of 70% was evaluated on the basis of the following evaluation criteria. It is to be noted that the improvement effect of the calcium sulfate crystal in corrosion resistance is not confirmed in the case of the evaluation criterion of "X".

<Corrosion Resistance Evaluation Criteria>

⊙: rust formation area ratio less than 10%.

○: rust formation area ratio of 10% or more and less than 20%.

Δ: rust formation area ratio of 20% or more and less than 50%.

×: rust formation area ratio of 50% or more.

Table 3 shows the results of the corrosion resistance evaluation. The calcium sulfate reagent according to the comparative example has significant rust formation observed, whereas the steels all have rust formation suppressed in the case of the solid lubricants 1A and 2A according to the examples. On the other hand, the solid lubricants 1a and 2a according to the comparative example using the alkali metal salts of the inorganic acid salt or organic acid salts combined so as not to deposit poorly soluble or insoluble calcium compounds deposited in the coating treatment for the calcium sulfate crystal have significant rust formation observed as in the case of the calcium sulfate reagent by way of comparison.

TABLE 3

| | Solid Lubricant | Result of Corrosion Resistance Evaluation |
|---|---|---|
| Example | Solid Lubricant 1 A | ⊙ |
| | Solid Lubricant 2 A | ⊙ |
| Comparative Example | Solid Lubricant 1 a | X |
| | Solid Lubricant 2 a | X |
| | Calcium Sulfate Reagent | X |

III. Lubricating Performance Evaluation

An object of this embodiment is to provide a coating for making a contacting metal material surface less likely to rust, without decreasing the performance of the scale-like calcium sulfate as a solid lubricant. In this sense, a lubricating performance evaluation using the seizure promoting test was conducted for solid lubricants, including the solid lubricants produced in the section I according to the examples and comparative examples, and a common solid lubricant as a reference.

The solid lubricants produced in the section I according to the examples and the comparative examples and calcium sulfate dihydrate powder (first-class reagent, from KISHIDA CHEMICAL Co., Ltd.), as well as graphite and molybdenum disulfide as references were used to prepare lubricating coating materials for coating test pieces for lubricating performance evaluation, and the test pieces for lubricating performance evaluation were created in the following manner.

For the lubricating coating materials, aqueous dispersions of 15 mass % in solid content were prepared so that the mass ratio of solid lubricant:binder:lubricating agent was 7:2:1 in terms of solid content. It is to be noted that for the preparation, polyvinyl alcohol and an aqueous dispersion of a carnauba wax were respectively used as the binder and the lubricating agent. The lubricating coating materials respectively prepared were applied onto surfaces of barrel-shaped test pieces, and then dried in a hot-air oven at 100° C. to form films of the lubricating coating materials on the surfaces of the test pieces. The deposition of the film formed was approximately around 15 g/m$^2$. It is to be noted that upsetting to an upsetting ratio of 45% was applied to cylindrical steels (S10C) of 14 mm in diameter and 32 mm in length with both end surfaces restrained so as to keep from expanding, and the created steels used for the barrel-shaped test pieces. The surface roughness Rz was on the order of 9 μm around the most protruded regions at the side surfaces of the test pieces.

Figure 6:
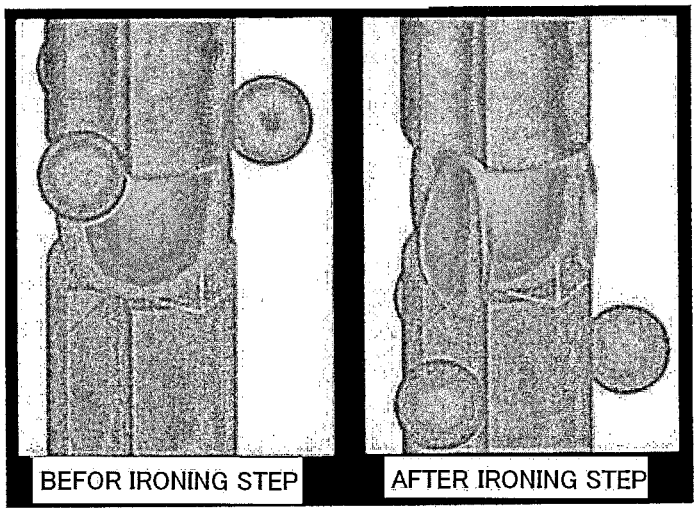
FIG. 6 is an image diagram of a ball ironing tribo-step for making a lubricating performance evaluation.

The lubricating performance evaluation was made by using only the ironing step in the upsetting-ball ironing tribo-type friction test method disclosed in a reference (Akinori Takahashi, Masatoshi Hirose, Shinobu Komiyama, and Wang Zhigang: 62nd Plastic Working Federation Lecture Meeting Preprint (2011), 89-90). FIG. 6 shows an image diagram of the ironing step. The upper and lower end surfaces of barrel-shaped test pieces was sandwiched by molds, and the protrusions of the side surfaces were subjected to ironing with the use of three ball-shaped molds (SUJ-2 bearing balls of 10 mm in diameter). This working is intense working where the maximum surface area enlargement of the part subjected to ironing is more than 200 times. As lubricating performance evaluation on each of the lubricating films, the degree of seizure in the last half of the ironing with a great surface area enlargement is evaluated on the basis of the following evaluation criteria shown in FIG. 7.

The results of the lubricating performance evaluation are shown in Table 4. The solid lubricants 1A and 2A according to the present examples and the solid lubricants 1a and 2a according to the comparative examples have lubricating performance comparable to that of the calcium sulfate, and the coating treatment has no adverse influence observed on the lubricating performance. The calcium sulfate has intermediate lubricating performance between the molybdenum disulfide and graphite evaluated as references.

TABLE 4

| | Solid Lubricant | Result of Lubricating Perfomance Evaluation |
|---|---|---|
| Example | Solid Lubricant 1 A | ⊙ |
| | Solid Lubricant 2 A | ⊙ |
| Comparative Example | Solid Lubricant 1 a | ○ |
| | Solid Lubricant 2 a | ○ |
| | Calcium Sulfate Reagent | ○ |
| | Molybdenum Disulfide | ⊙ |
| | Graphite | Δ |

<<Examples of Highly Lubricating Coated Scale-Like Calcium Sulfate>>

I. Production of Highly Lubricating Solid Lubricant

<Example 1B of Production of Highly Lubricating Solid Lubricant>

To 550 g of a 5.2 mass % sulfuric acid aqueous solution, 450 g of slurry obtained by mixing 30 g of calcium carbonate with respect to 420 g of water while agitation was gradually added over 10 minutes while agitation with the use of a propeller agitator rotating at 800 rpm. It is to be noted that the liquid temperature was about 30° C. after the completion of the addition. The thus synthesized calcium sulfate slurry was subjected to filtration and drying to obtain a powder of scale-like calcium sulfate crystals of 0.8 μm in average thickness. It is to be noted that the intensity ratio of (020) plane/(021) plane was 119.9, which was obtained from the result of analyzing the calcium sulfate crystal by an X-ray diffraction method. In 180 g of water, 20 g of this scale-like calcium sulfate powder was mixed while agitation to obtain slurry, and the slurry was adjusted to pH 9 with the addition of an aqueous solution of sodium hydroxide thereto, and heated up to 85° C. Therein, an aqueous solution of 10 g of sodium stearate dissolved in 85 g of hot water at 90° C., in which 5 g of a carnauba wax was dispersed, was gradually delivered by drops while agitation with a magnetic stirrer. Thereafter, the agitation was continued for 30 minutes to complete the treatment for depositing a fatty acid calcium salt onto the surface of the calcium sulfate crystal. The production of a highly lubricating solid lubricant 1B was completed with the slurry of the calcium sulfate powder after the treatment for deposition. It is to be noted that the mass ratio of calcium sulfate crystal/fatty acid calcium salt was 2 in this lubricant. In addition, the shear friction factor of this lubricant was less than 0.2.

<Example 2B of Production of Highly Lubricating Solid Lubricant>

Under a condition controlled to a liquid temperature of 10° C. or lower with the use of a cooling machine, to 450 g of a suspension obtained by mixing 45 g of calcium carbonate in 405 g of water while agitation, 550 g of a 8.0 mass % sulfuric acid aqueous solution was added over 5 minutes while agitation with the use of a propeller agitator rotating at 800 rpm. The propeller agitation was further continued for 30 minutes to complete the synthesis. The thus synthesized calcium sulfate slurry was subjected to filtration and drying to obtain a powder of scale-like calcium sulfate crystals of 1.2 μm in average thickness. It is to be noted that the intensity ratio of (020) plane/(021) plane was 21.5, which was obtained from the result of analyzing the calcium sulfate crystal by an X-ray diffraction method. In 180 g of water, 20 g of this scale-like calcium sulfate powder was mixed while agitation to obtain slurry, and the slurry was adjusted to pH 9 with the addition of an aqueous solution of sodium hydroxide thereto, and heated up to 85° C. Therein, an aqueous solution of 5 g of sodium stearate dissolved in 95 g of hot water at 90° C. was gradually delivered by drops while agitation with a magnetic stirrer. Thereafter, the agitation was continued for 30 minutes to complete the treatment for depositing a fatty acid calcium salt onto the surface of the calcium sulfate crystal. The production of a highly lubricating solid lubricant 2B was completed with the slurry of the calcium sulfate powder after the treatment for deposition. It is to be noted that the mass ratio of calcium sulfate crystal/fatty acid calcium salt was 20 in this lubricant. In addition, the shear friction factor of this lubricant was less than 0.2.

<Example 3B of Production of Highly Lubricating Solid Lubricant>

To 550 g of a 5.2 mass % sulfuric acid aqueous solution, 450 g of slurry obtained by mixing 30 g of calcium carbonate with respect to 420 g of water while agitation was gradually added over 10 minutes while agitation with the use of a propeller agitator rotating at 800 rpm. It is to be noted that the liquid temperature was about 30° C. after the completion of the addition. The thus synthesized calcium sulfate slurry was subjected to filtration and drying to obtain a powder of scale-like calcium sulfate crystals of 0.8 μm in average thickness. It is to be noted that the intensity ratio of (020) plane/(021) plane was 119.9, which was obtained from the result of analyzing the calcium sulfate crystal by an X-ray diffraction method. In 180 g of water, 20 g of this scale-like calcium sulfate powder was mixed while agitation to obtain slurry, and the slurry was adjusted to pH 9 with the addition of an aqueous solution of sodium hydroxide thereto, and heated up to 80° C. Therein, an aqueous solution of 2.5 g of potassium oleate and 5 g of sodium stearate sequentially dissolved in 92.5 g of hot water at 90° C. was gradually delivered by drops while agitation with a magnetic stirrer. Thereafter, the agitation was continued for 30 minutes to complete the treatment for depositing a fatty acid calcium salt onto the surface of the calcium sulfate crystal. The production of a highly lubricating solid lubricant 3B was completed with the slurry of the calcium sulfate powder after the treatment for deposition. It is to be noted that the mass ratio of calcium sulfate crystal/fatty acid calcium salt was 4 in this lubricant. In addition, the shear friction factor of this lubricant was less than 0.2.

<Comparative Example 1b of Production of Highly Lubricating Solid Lubricant>

In 180 g of water, 20 g of a first-class reagent of calcium sulfate dihydrate powder (plate-like crystals of 5 μm or more in crystal thickness, the intensity ratio of (020) plane/(021) plane is 8.7 by an X-ray diffraction method) from KISHIDA CHEMICAL Co., Ltd., was mixed while agitation to obtain slurry, and the slurry was adjusted to pH 9 with the addition of an aqueous solution of sodium hydroxide thereto. Therein, an aqueous dispersion of commercially available potassium stearate was added while agitation so as to achieve the addition of 10 g as a solid content. The production of a highly lubricating solid lubricant 1b was completed with the slurry of the calcium sulfate powder.

<Comparative Example 2b of Production of Highly Lubricating Solid Lubricant>

In 180 g of water, 20 g of a first-class reagent of calcium sulfate dihydrate powder (plate-like crystals of 5 μm or more in crystal thickness, the intensity ratio of (020) plane/(021) plane is 8.7 by an X-ray diffraction method) from KISHIDA CHEMICAL Co., Ltd., was mixed while agitation to obtain slurry, and the slurry was adjusted to pH 9 with the addition of an aqueous solution of sodium hydroxide thereto. Therein, an aqueous dispersion of commercially available polytetrafluoroethylene was added while agitation so as to achieve the addition of 10 g as a solid content. The production of a highly lubricating solid lubricant 2b was completed with the slurry of the calcium sulfate powder.

II. Cold Forging Performance Evaluation

The highly lubricating solid lubricants produced in the section I according to the examples and the comparative examples and untreated calcium sulfate dihydrate powder (first-class reagent, from KISHIDA CHEMICAL Co., Ltd.), as well as graphite and molybdenum disulfide as references were used to prepare lubricating coating materials for coating test pieces for cold forging performance evaluation, and the test pieces for cold forging performance evaluation were created in the following manner.

For the lubricating coating materials, aqueous dispersions of 8 mass % in total solid content were prepared so that the mass ratio of solid lubricant:binder was 8:2 in terms of solid content. It is to be noted that polyvinyl alcohol was used as the binder for the preparation. The lubricating coating materials respectively prepared were applied onto surfaces of cylindrical steels (S10C) of 14 mm in diameter and 32 mm in length as test pieces, and then dried in a hot-air oven at 100° C. to form films of the lubricating coating materials on the surfaces of the test pieces. The deposition of the film formed was approximately around 5 g/m$^2$.

Figure 12:
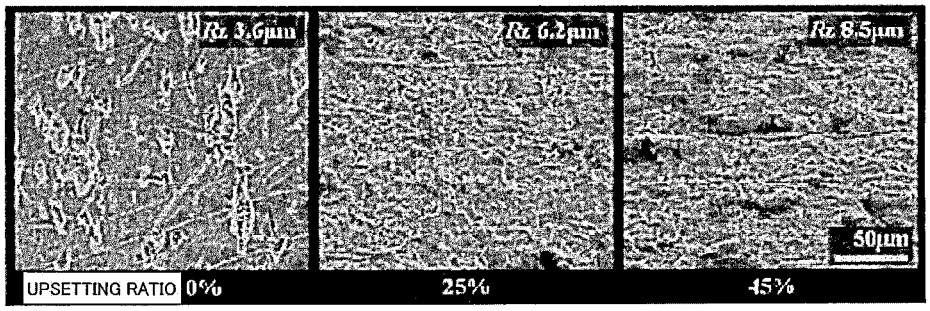
FIG. 12 shows conditions of surface damage to materials to be worked, which are caused by free surface deformations in a cold forging performance evaluation.

The cold forging performance evaluation was made by using the upsetting-ball ironing tribo-type friction test method disclosed in a reference (Akinori Takahashi, Masatoshi Hirose, Shinobu Komiyama, and Wang Zhigang: 62nd Plastic Working Federation Lecture Meeting Preprint (2011), 89-90). In this test method, upsetting for compressing end surfaces of the cylindrical test pieces with upper and lower molds under a constraint condition was first carried out at an upsetting ratio of 45% to deform the test pieces into barrel shapes with side surfaces protruded. The side surfaces of the test pieces in this case have surface damage caused by free surface deformations as shown in FIG. 12, where the surface roughness Rz is even twice or more as large as before, thus damaging the lubricating coating films located thereon as upper layers. Then, as shown in FIG. 6, the protrusions of the side surfaces were subjected to ironing with the use of three ball-shaped molds (SUJ-2 bearing balls of 10 mm in diameter). This working is intense working where the maximum surface area enlargement of the part subjected to ironing is more than 200 times, and the lubricating coating films are tested for the seizure suppressing ability while being forced to be extremely reduced in thickness.

For the cold forging performance evaluation for each lubricating coating film, the adhesion performance of the lubricating coating film was evaluated by visual observation of the film dropped off in the upsetting step, and the lubricating performance in the thin-film state was evaluated by visual observation of the degree of seizure in the last half of the ironing with a great surface area enlargement. The degraded adhesion performance of the lubricating coating film fails to achieve the required lubricating performance, and also clogs the cool forging molds to cause problems such as defective dimensions of molded products, and it can be thus determined that it is not possible to industrially use the film. In addition, the lubricating performance degraded when the thin-film state is forced is not considered to provide a lubricating coating film as an object of the present invention, which can be used in severer friction surface environments.

The evaluation criteria are listed below for evaluating the adhesion from the film dropped off in the upsetting step. The films evaluated as "X" are not suited for practical use.

<Evaluation Criteria>

○: no peeling observed in the lubricating coating film on the protruded side surface of the test piece deformed into a barrel shape.

Δ: peeling observed partially in the lubricating coating film on the protruded side surface of the test piece deformed into a barrel shape.

×: peeled entirely in the lubricating coating film on the protruded side surface of the test piece deformed into a barrel shape.

Figure 7:
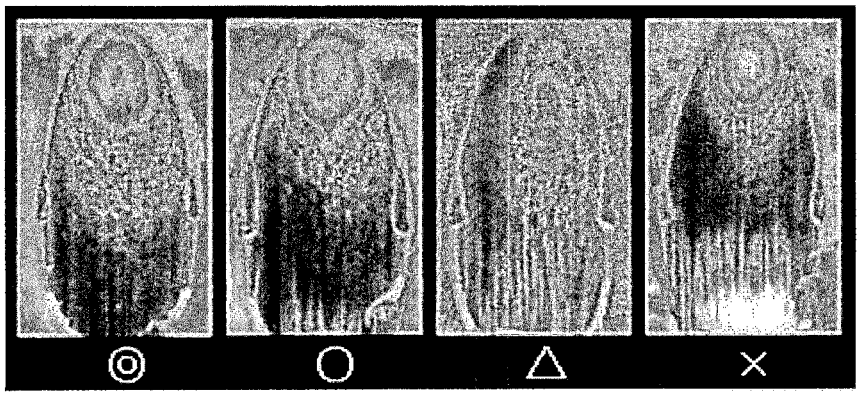
FIG. 7 is evaluation criteria indicating the degrees of seizure for making a lubricating performance evaluation.

FIG. 7 shows evaluation criteria indicating the degrees of seizure for evaluating the lubricating performance when the lubricating coating films are forced into thin-film states.

Table 5 shows the results of the cold forging performance evaluation. The highly lubricating solid lubricants 1B to 3B according to the present examples exhibited excellent adhesion performance comparable to that of the untreated calcium sulfate, and also achieved a practical level of lubricating performance in thin films. On the other hand, the highly lubricating solid lubricants 1b and 2b according to the comparative examples failed to achieve the practical level, because of the decreased adhesion performance of the lubricating coating films due to the commercially available organic lubricant blended. The untreated calcium sulfate, as well as the molybdenum disulfide and the graphite, which were evaluated as references, caused significant seizure in extremely intense working, although the adhesion was not disturbed without coexistence with any organic lubricant component.

TABLE 5

| | Solid Lubricant | Adhesion Performance Evaluation Result | Cold Forging Performance Evaluation Result |
|---|---|---|---|
| Example | Highly Lubricating Solid Lubricant 1B | ○ | ⊙ |
| | Highly Lubricating Solid Lubricant 2B | ○ | ⊙ |
| | Highly Lubricating Solid Lubricant 3B | ○ | ⊙ |
| Comparative Example | Highly Lubricating Solid Lubricant 1b | X | Δ |
| | Highly Lubricating Solid Lubricant 2b | X | Δ |
| | Calcium Sulfate Reagent | ○ | X |
| | Molybdenum Disulfide | Δ | X |
| | Graphite | Δ | X |

What is claimed is:

1. A lubricating coating agent for plastic working comprising 6 mass % to 98 mass % in terms of solid content ratio in a coating film, of a calcium sulfate hydrate deposited by reacting a sulfuric acid or a sulfate with a calcium compound in water, which is 1.5 μm or less in thickness of crystal and scale-like shape; and 2 mass % to 94 mass % in terms of the solid content ratio in the coating film, being comprised of a binder component and/or one or more additives.

2. The lubricating coating agent according to claim 1, wherein the calcium sulfate hydrate has an intensity ratio of (020) plane/(021) plane of 10 or more, said ratio being obtained from an analysis result in an X-ray diffraction method directed to a smooth surface of a crystal aggregation created by dry-solidifying a dispersion of the crystals of the calcium sulfate hydrate in water on a flat surface at a temperature of 80° C. or less.

3. The lubricating coating agent according to claim 1, having a suspension stability of 15 mm or more, measured as a sedimentation layer height of 50 ml of a 3 mass % dilution in water of the lubricating coating agent upon storage for 24 hours at 40° C. in a 35 mm diameter cylindrical bottle.

4. The lubricating coating agent according to claim 1, wherein the calcium sulfate hydrate is present at 10 mass % to 90 mass %.

5. The lubricating coating agent according to claim 1, wherein the calcium sulfate hydrate is present at 60 mass % to 98 mass %.

6. The lubricating coating agent according to claim 1, comprising no black components and having an L* value of 50 or more in the L*a*b* color specification system according to JIS-Z-8729.

7. A lubricating coating agent for plastic working comprising at 5 mass % to 98 mass % in terms of solid content ratio in a coating film, of calcium sulfate hydrate crystals, produced by reacting a sulfuric acid or a sulfate with a calcium compound in water, said crystals having a scale-like shape and an average thickness of 1.5 micron or less; wherein said crystals comprise surfaces that are at least partially coated with a calcium compound coating having a solubility in water that is less than solubility in water of the calcium sulfate hydrate.

8. The lubricating coating agent according to claim 7, wherein the calcium compound coating is selected from the group consisting of calcium salts of inorganic acids, calcium salts of organic acids and mixtures thereof.

9. The lubricating coating agent according to claim 8, wherein a mass ratio of the calcium sulfate hydrate crystal to calcium compound coating is 5 to 2000.

10. The lubricating coating agent according to claim 9, wherein the calcium compound coating is selected from the group consisting of calcium fluoride, calcium iodate, calcium phosphite, calcium phosphate, calcium monohydrogen phosphate, calcium diphosphate, calcium metaphosphate, calcium carbonate, calcium silicate, calcium metasilicate, calcium tetraborate, calcium tungstate, calcium molybdate, calcium oxalate, calcium stearate, calcium oleate, resins with calcium coordinated on a hydrated group, water-dispersible resin emulsions with calcium coordinated on a hydrated group and mixtures thereof.

11. The lubricating coating agent according to claim 8, wherein the calcium compound coating is selected from the group consisting of calcium salts of saturated fatty acids having 12 to 20 carbon atoms or calcium salts of unsaturated fatty acids having 12 to 20 carbon atoms and mixtures thereof; and wherein a mass ratio of the calcium sulfate hydrate crystal to fatty acid calcium salt deposited on the surface of the calcium sulfate hydrate crystal is 1-20.

12. A method of making a lubricating coating agent comprising steps of:

a. reacting a mixture of:
   i. a sulfuric acid or a sulfate salt; and
   ii. a calcium compound selected from calcium hydroxide, calcium carbonate, calcium phosphate, calcium chloride, calcium oxalate, calcium citrate and mixtures thereof;

in liquid water at temperatures of 30 deg. C or less, to thereby produce a dispersion in water of calcium sulfate hydrate crystals; i) and ii) being present in amounts such that concentration of said crystals is 10 wt % or less, with i) being present in excess;

b. agitating the dispersion such that the calcium sulfate hydrate crystals produced have a scale-like shape and 1.5 microns or less average thickness; and c. neutralizing the dispersion in water of calcium sulfate hydrate crystals;

d. optionally, coating at least a portion of surfaces of the calcium sulfate hydrate crystals with a calcium compound coating having a solubility in water that is less than solubility in water of the calcium sulfate hydrate; and e. drying, forming a slurry, mixing with a binder component, mixing with additives or combinations thereof.

13. A metal material having a surface coated with a lubricating coating agent made according to claim 12, said lubricating coating agent being dried upon said surface at temperatures of 190° C. or lower.

14. The metal material according to claim 13, wherein the lubricating coating agent contains, as a binder component, at least one selected from aqueous inorganic salts, aqueous organic acid salts, and aqueous resins.

15. The metal material according to claim 13, wherein the lubricating coating agent further comprises at least one lubricating supplemental component selected from oils, soap, waxes, and extreme pressure agents.

* * * * *